US010486928B2

(12) United States Patent
Mizobe et al.

(10) Patent No.: US 10,486,928 B2
(45) Date of Patent: Nov. 26, 2019

(54) SHEET DETECTING DEVICE, SHEET FEEDING UNIT INCLUDING THE SAME AND IMAGE FORMING APPARATUS

(71) Applicant: CANON KABUSHIKI KAISHA, Tokyo (JP)

(72) Inventors: Junichiro Mizobe, Yokohama (JP); Yoshinori Hashimoto, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/956,940

(22) Filed: Apr. 19, 2018

(65) Prior Publication Data

US 2018/0237245 A1 Aug. 23, 2018

Related U.S. Application Data

(62) Division of application No. 14/940,422, filed on Nov. 13, 2015, now Pat. No. 9,975,716.

(30) Foreign Application Priority Data

Nov. 19, 2014 (JP) ..... 2014-234146
Nov. 26, 2014 (JP) ..... 2014-239035

(51) Int. Cl.
*B65H 7/14* (2006.01)
*B65H 7/02* (2006.01)
(Continued)

(52) U.S. Cl.
CPC ..... *B65H 7/04* (2013.01); *B65H 1/04* (2013.01); *B65H 1/266* (2013.01); *B65H 2402/31* (2013.01); *B65H 2402/32* (2013.01); *B65H 2405/324* (2013.01); *B65H 2407/21* (2013.01); *B65H 2511/12* (2013.01);
(Continued)

(58) Field of Classification Search
CPC ... B65H 7/02; B65H 7/04; B65H 7/14; B65H 2553/612; B65H 43/08; B65H 43/02; B65H 2511/12; B65H 1/04; B65H 1/266
See application file for complete search history.

(56) References Cited

U.S. PATENT DOCUMENTS 4,849,796 A 7/1989 Murakami
5,016,864 A 5/1991 Nonami
(Continued)

FOREIGN PATENT DOCUMENTS

JP 04140255 A * 5/1992
JP 10129887 A * 5/1998
(Continued)

OTHER PUBLICATIONS

Japanese Office Action dated Jul. 31, 2018, in related Japanese Patent Application No. 2014-239035.

*Primary Examiner* — Luis A Gonzalez
(74) *Attorney, Agent, or Firm* — Venable LLP

(57) ABSTRACT

A sheet detecting device includes a moving member supported movably from a standby position to a detecting position detecting a sheet by being pushed by the sheet moving on a sheet stacking portion toward a first direction and a detecting sensor detecting the move of the moving member. The sheet detecting device also includes a retracting mechanism retracting the moving member movably to the detecting position in associate with a move of the sheet to a second direction orthogonal to the first direction.

10 Claims, 17 Drawing Sheets

(51) Int. Cl.

| | |
|---|---|
| ***B65H 43/08*** | (2006.01) |
| ***B65H 7/04*** | (2006.01) |
| ***B65H 1/04*** | (2006.01) |
| ***B65H 1/26*** | (2006.01) |

(52) U.S. Cl.
CPC ..... *B65H 2511/22* (2013.01); *B65H 2511/51* (2013.01); *B65H 2553/612* (2013.01)

(56) References Cited

U.S. PATENT DOCUMENTS

| | | | | |
|---|---|---|---|---|
| 5,915,690 | A | 6/1999 | Surya | |
| 6,651,977 | B2 | 11/2003 | Tanaka | |
| 2004/0041329 | A1* | 3/2004 | Hiraoka ..... | B65H 7/04<br>271/110 |
| 2007/0020007 | A1 | 1/2007 | Azuma | |

FOREIGN PATENT DOCUMENTS

| | | | |
|---|---|---|---|
| JP | 2002-104662 | A | 4/2002 |
| JP | 2004-083234 | A | 3/2004 |
| JP | 2007-008704 | A | 1/2007 |
| JP | 2007-051005 | A | 3/2007 |
| JP | 2009-161281 | A | 7/2009 |

* cited by examiner

SHEET DETECTING DEVICE, SHEET FEEDING UNIT INCLUDING THE SAME AND IMAGE FORMING APPARATUS

This application is a divisional of application Ser. No. 14/940,422, filed Nov. 13, 2015.

BACKGROUND OF THE INVENTION

Field of the Invention

The present invention relates to a sheet detecting device detecting whether or not a sheet is present, to a sheet feeding unit including the same, and to an image forming apparatus such as a printer, a copier, a multi-function printer.

Description of the Related Art

An image forming apparatus such as a printer, a copier, a facsimile machine includes a sheet feeding unit having a sheet stacking portion on which a plurality of sheets is stacked and a feed roller feeding the sheets stacked on the sheet stacking portion sequentially one by one to an image forming portion. The sheet feeding unit is also provided with side restricting guides for restricting a widthwise position of the sheet stacked on the sheet stacking portion on both sides of the sheet. The side restricting guides thus eliminate misalignment in the sheet width direction (orthogonal to a sheet conveying direction) between an image to be formed on the sheet and the sheet to form the image at an appropriate position on the sheet. While the side restricting guides are moved in the sheet width direction by a user in general, there is one in which a side restricting guide of only one side is moved to another side, one in which both side restricting guides are moved to a center between them, or the like. When the side restricting guides on the both sides of the sheet are moved to positions abutting against widthwise side edges of the sheet, the sheet is fixed and held at that position.

Still further, the sheet stacking portion is provided with a sheet detecting device detecting whether or not a sheet to be stacked on a feed tray is present. This sheet detecting device is generally configured such that a swingable detecting member is disposed in a vicinity of the feed tray and detects whether or not the sheet is present on the tray by abutting with the sheet. Accordingly, the detecting member projects at a position where the sheet is set. Therefore, if the sheet is inserted from a width direction side of the sheet stacking portion when the user sets the sheet on the tray, there is a possibility that the sheet on a way of moving in the width direction is caught by the detecting member. In such a case, there is a possibility that the sheet is damaged or a non-detecting state occurs.

Then, conventionally, in order to facilitate setting of the sheet, there is proposed a configuration in which a sheet detecting member is disposed while inclining with respect to a sheet conveying direction so that the sheet is set on the tray without any problem even if a user inserts the sheet from any direction as disclosed in Japanese Patent Application Laid-open No. 2007-51005 for example.

Still further, there is proposed a configuration in which a supporting hole supporting a rotational shaft of a sheet detecting lever is formed not into a circular shape but into a long hole shape extending upward and retracting the sheet detecting lever upward if a force in a vertical direction is applied to the sheet detecting lever as disclosed in Japanese Patent Application Laid-open Nos. 2009-161281 and 2004-83234 for example.

SUMMARY OF THE INVENTION

According to a first aspect of the invention, a sheet detecting device includes a sheet stacking portion on which a sheet is stacked, an edge restricting portion movable to restrict an edge of the sheet stacked on the sheet stacking portion, a detecting member detecting the sheet stacked on the sheet stacking portion, and a retract portion interlocked with a moving operation of the edge restricting portion and retracting the detecting portion from a sheet detecting position.

According to a second aspect of the invention, a sheet detecting device includes a moving member moved by being pushed by a sheet, a detecting sensor detecting the move of the moving member, and a supporting member supporting the moving member, pushed from a first direction, movably in the first direction and supporting the moving member, pushed from a second direction which is orthogonal to the first direction, movably in the first and second directions.

According to a third aspect of the invention, a sheet detecting device includes a moving member supported movably from a standby position to a detecting position detecting a sheet by being pushed by the sheet moving on a sheet stacking portion toward a first direction, a detecting sensor detecting the move of the moving member, and a retracting mechanism retracting the moving member movably to the detecting position in association with the move of the sheet in a second direction orthogonal to the first direction.

Further features of the present invention will become apparent from the following description of exemplary embodiments with reference to the attached drawings.

DESCRIPTION OF THE EMBODIMENTS

An image forming apparatus including a sheet detecting device and a sheet feeding unit of embodiments of the present invention will be described with reference to the drawings.

First Embodiment

Overall Configuration of Image Forming Apparatus

Figure 1:
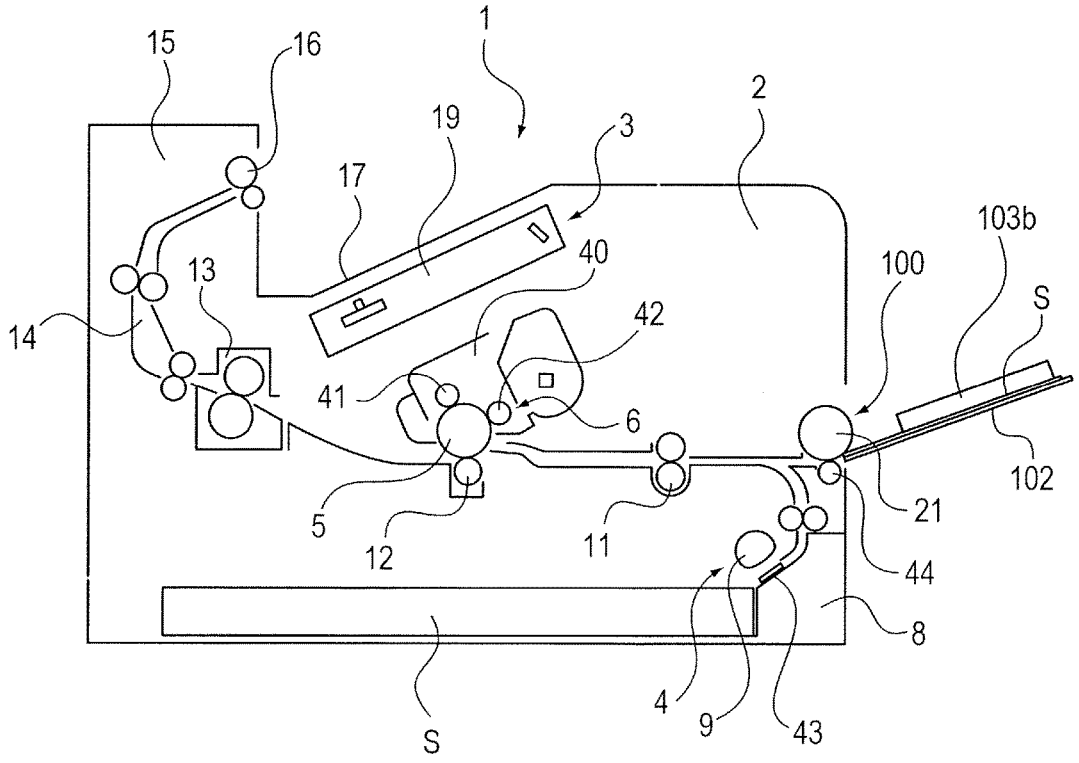
FIG. 1 is a schematic section view illustrating a configuration of an image forming apparatus according to an embodiment of the present invention.

At first, an overall configuration of an image forming apparatus will be described. FIG. 1 is a schematic section view illustrating the configuration of the sheet feeding unit and an exemplary image forming apparatus including the same. The image forming apparatus 1 of the present embodiment is a laser beam printer, and an apparatus body 2 thereof includes an image forming portion 3 electro-photographically forming an image. The apparatus body 2 also includes a sheet feeding portion 4 feeding a sheet S to the image forming portion 3, a fixing unit 13 fixing the image formed in the image forming portion 3 onto the sheet, and a sheet discharging unit 15 discharging the sheet on which the image has been fixed to a discharge tray 17. Here, the image forming portion 3 includes a process cartridge 40 having developer (toner). The process cartridge 40 also includes a photosensitive drum 5, i.e., an image bearing member, and a developing unit 6. The image forming portion 3 also includes a laser scanner 19 exposing the photosensitive drum 5.

In forming an image, a surface of the photosensitive drum 5 is homogeneously charged by a charging roller 41X, and the photosensitive drum 5 is exposed by a laser beam emitted from the laser scanner 19 to form an electrostatic latent image on the surface of the photosensitive drum 5. After that, a toner image is formed on the surface of the photosensitive drum 5 by developing the latent image by the developing unit 6. Still further, a sheet feeding portion (second sheet feeding unit) includes a sheet feed cassette 8 removably attached to the apparatus body 2 and a feed roller (sheet feeding member) 9 provided above the sheet feed cassette 8 to deliver the sheet S stored in the sheet feed cassette 8.

The sheet S in the sheet feed cassette 8 is separated by frictional force of a separating pad 43X in synchronism with a toner image forming operation of the image forming portion 3 and is conveyed one by one by the feed roller 9 to a registration roller pair 11. It is noted that the sheet S thus conveyed to the registration roller pair 11 is conveyed by the registration roller pair 11 to a transfer portion formed by the photosensitive drum 5 and the transfer roller 12. Next, the toner image formed on the surface of the photosensitive drum 5 is transferred onto the sheet S conveyed to the transfer portion. Then, the sheet S is conveyed to the fixing unit 13 and the toner image is fixed on the sheet S by being heated and pressed in the fixing unit 13. Next, after fixing the image as described above, the sheet S is discharged to the discharge tray 17 provided on an upper surface of the apparatus body 2 via the discharge path 14 by a discharging roller pair 16 provided in the sheet discharging unit 15.

Sheet Feeding Unit Including Sheet Detecting Device

The image forming apparatus 1 of the present embodiment is provided with a manual sheet feeding unit (first sheet feeding unit) 100 in order to be able to handle sheets of various sizes. The sheet feeding unit 100 separates and feeds sheets stacked on a sheet stacking portion 102 openably attached to the apparatus body 2 one by one by a feed roller 21 and a separation roller 44. The feed roller 21 composes a feed portion feeding the sheet stacked on the sheet stacking portion.

Restricting Guide

Figure 2:
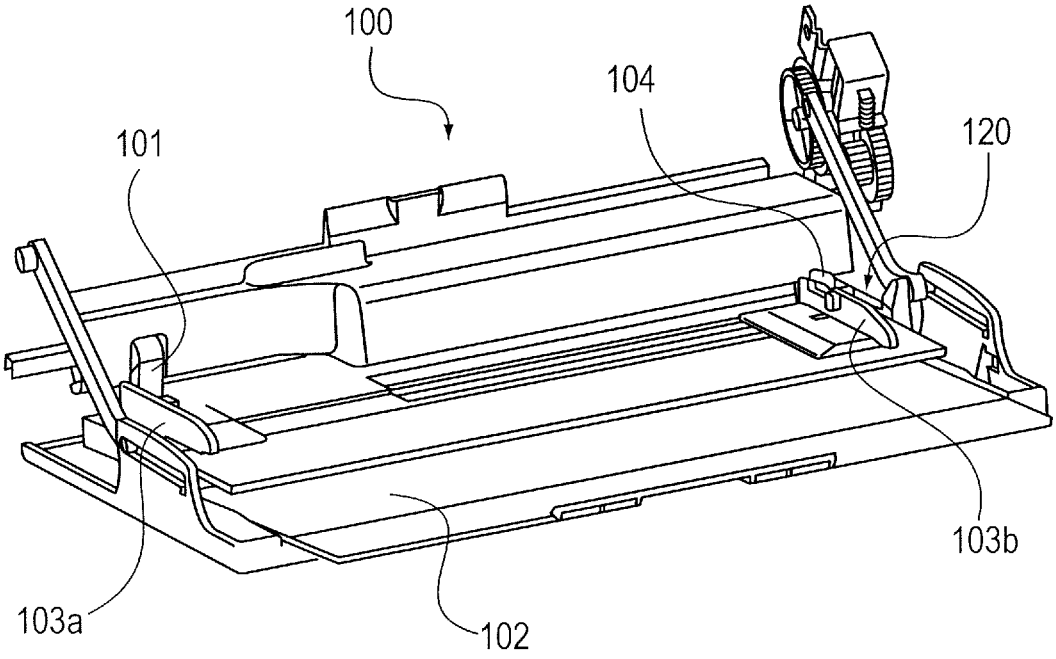
FIG. 2 is a perspective view of a sheet feeding unit.

As shown in FIG. 2, the sheet stacking portion 102 on which a plurality of sheets can be stacked is provided with an edge restricting portion 120 restricting both edges in a width direction (direction orthogonal to a sheet conveying direction) of the sheet to be stacked. The edge restricting portion 120 includes restricting guides (sheet width restricting portions) 103*a* and 103*b*, i.e., guide portions restricting and guiding the edge portions of the sheet, and a lock portion 121 (see FIG. 5A) locking the restricting guides from moving.

Figure 3A:
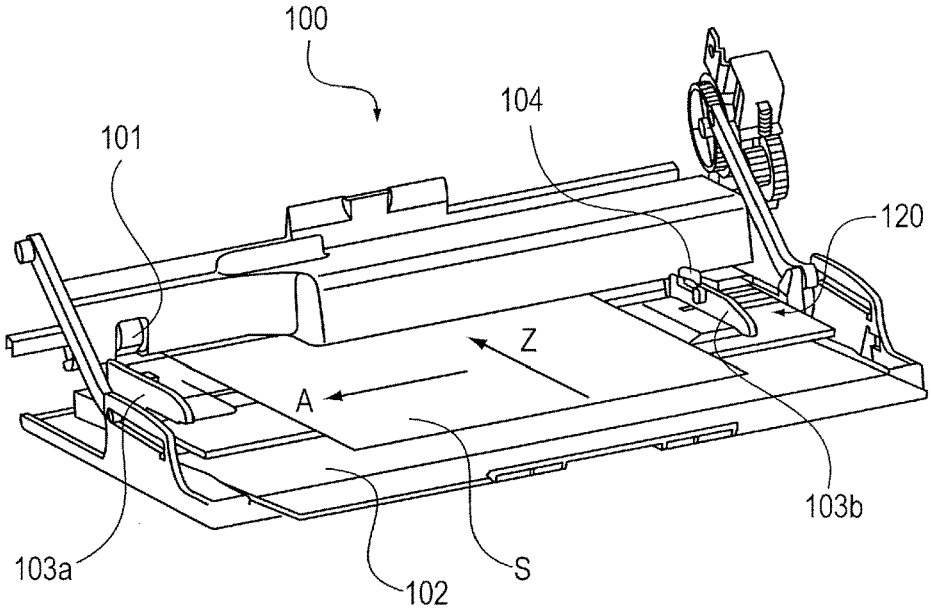
FIG. 3A illustrates the sheet feeding unit in setting a sheet on a sheet stacking portion.
Figure 3B:
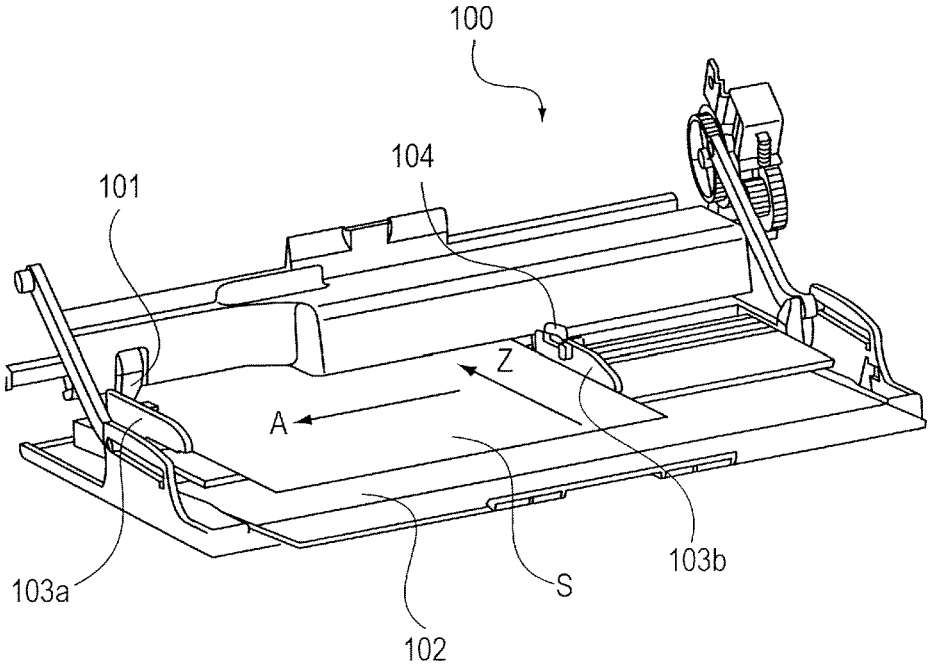
FIG. 3B illustrates the sheet feeding unit in a state in which the sheet has been set on the sheet stacking portion.

In the present embodiment, the restricting guide 103*a* on a left side with respect to the sheet conveying direction is fixed to the sheet stacking portion 102, and the right restricting guide 103*b* is provided movably in the sheet width direction with respect to the sheet stacking portion 102. Then, in setting a sheet on the sheet stacking portion 102, the restricting guides 103*a* and 103*b* are separated such that a distance between the restricting guides becomes greater than a width of the sheet and then, the sheet is inserted in a direction of an arrow Z as shown in FIG. 3A. Subsequently, the sheet is moved in a direction of an arrow A to position such that the edge of the sheet abuts with the left restricting guide 103*a*. Next, the right restricting guide 103*b* is moved so as to abut with the right edge of the sheet as shown in FIG. 3B and to position the widthwise both ends of the sheet. Thereby, the both edges of the sheet being fed are guided by the restricting guides 103*a* and 103*b* and the sheet is restricted from skewing.

Sheet Detecting Device

Figure 4A:
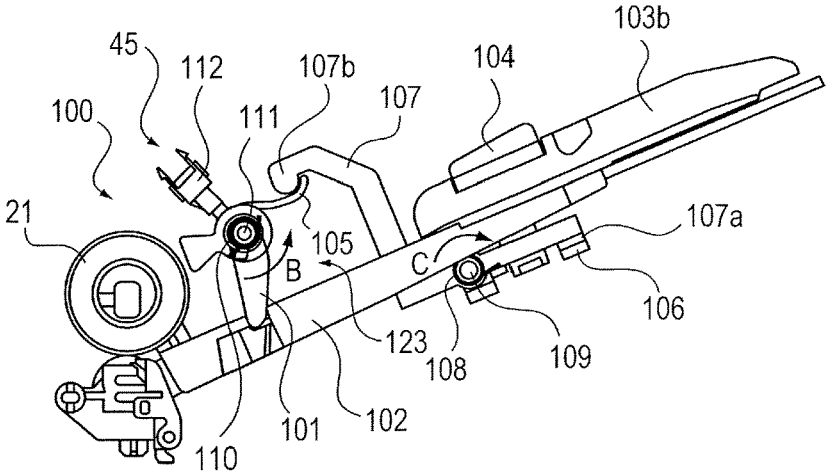
FIG. 4A is a section view of the sheet feeding unit in a state in which no sheet is stacked on the sheet stacking portion.
Figure 4B:
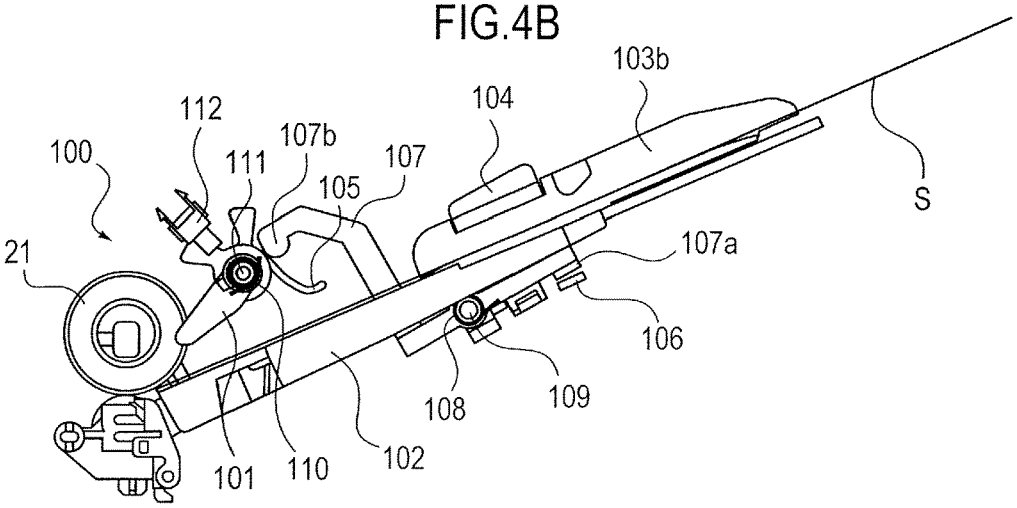
FIG. 4B is a section view of the sheet feeding unit in moving a restricting guide.
Figure 4C:
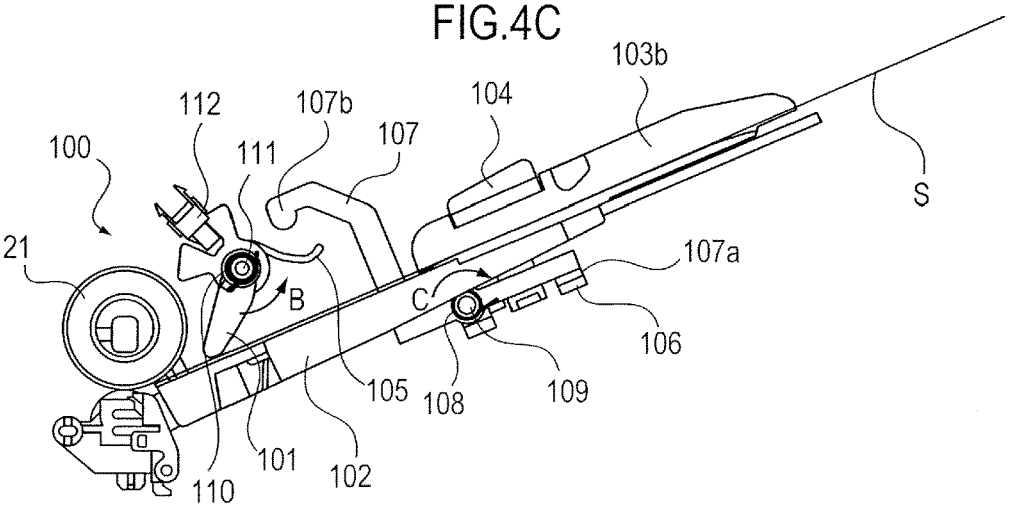
FIG. 4C is a section view of the sheet feeding unit in a state in which a sheet is stacked on the sheet stacking portion.

The image forming apparatus 1 of the present embodiment is also provided with a sheet detecting device 45 detecting whether or not the sheet is set on the sheet stacking portion 102 in a vicinity of the restricting guide 103*a*. As shown in FIGS. 2 and 4A, the sheet detecting device 45 detects whether or not the sheet is present by a detecting member 101 and a detecting sensor 112 composing a sheet detecting portion. It is noted that FIG. 4A illustrates the detecting member 101 in a state in which no sheet is present, and FIG. 4C illustrates the detecting member 101 in a state in which a sheet is present. FIG. 4B is a section view illustrating the detecting member 101 in a state of moving the restricting guide 103*b*.

The detecting member 101 is suspended turnably centering on a turning shaft 111 disposed above a sheet setting surface. Then, the detecting member 101 is turnable between a position (detecting position) where the detecting member 101 is in contact with the sheet being set on the sheet stacking portion 102 and a position (retracting position) where the detecting member 101 is not in contact with the sheet being set on the sheet stacking portion 102. The detecting sensor 112 detects the turning state of the detecting member 101 and includes a light emitting portion and a light receiving portion which faces the light emitting portion in the present embodiment. Thus, the detecting sensor 112 composes a transmission type sensor which detects a light beam emitted from the light emitting portion and blocked by the detecting member 101 by the light receiving portion.

In the state in which no sheet is set on the sheet stacking portion 102, the detecting member 101 is biased by a spring member 110 in a direction of an arrow B centering on the turning shaft 111 and is located at a first position where the detecting member 101 abuts with the sheet stacking portion 102 as shown in FIG. 4A. At this time, a part of the detecting member 101 is located at a position of blocking the detecting sensor 112 and thereby, the detecting sensor 112 detects that the state in which the sheet S is not present on the sheet stacking portion 102. During when the detecting sensor 112 detects that the sheet S is not present on the sheet stacking portion 102, the sheet feeding unit 100 is not actuated.

Meanwhile, when the sheet is set on the sheet stacking portion 102, the detecting member 101 turns by being pushed by a front edge of the sheet and moves from the position where the light beam of the detecting sensor 112 is blocked. Due to that, the detecting sensor 112 detects that the sheet S is present on the sheet stacking portion 102.

Lock Portion

Figure 5A:
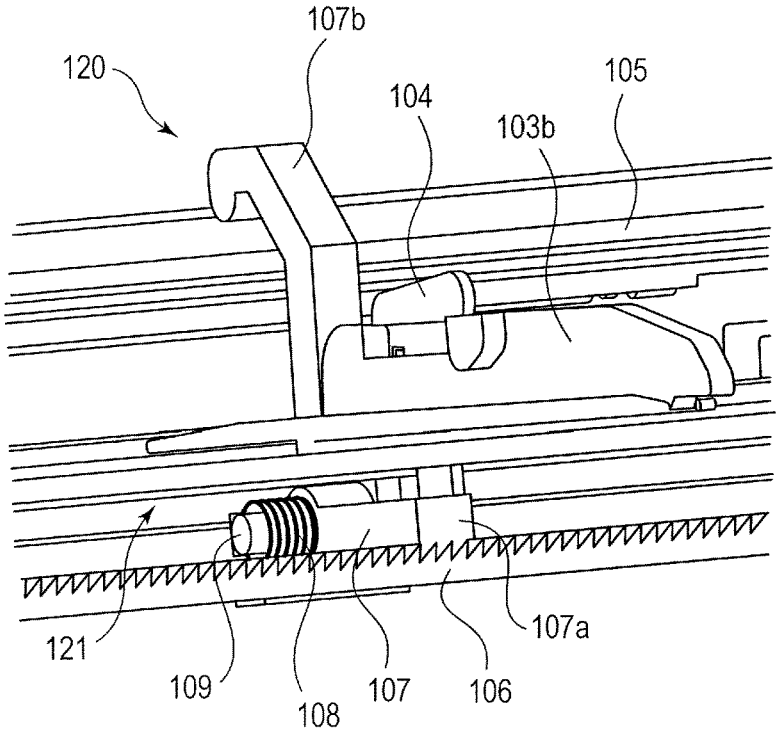
FIG. 5A illustrates the restricting guide in a state in which the restricting guide is locked.
Figure 5B:
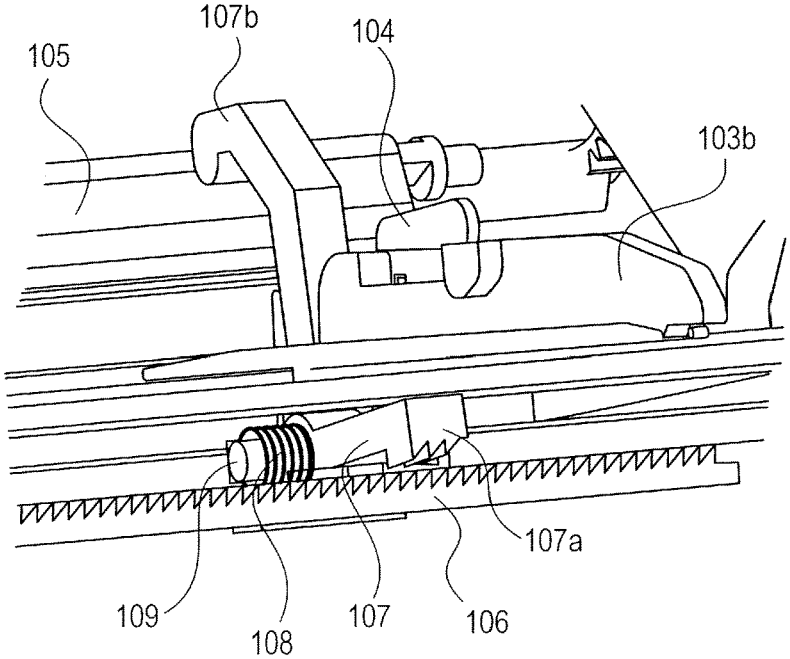
FIG. 5B illustrates the restricting guide in a state in which the restricting guide is unlocked.

The sheet feeding unit 100 is provided also with a lock portion 121 locking the restricting guide 103*b* from moving so that the restricting guide 103*b* movable in the sheet width direction is not moved unintentionally. As shown in FIGS. 5A and 5B, the lock portion 121 includes a lock rail 106 having saw-like teeth extending in the sheet width direction and a lock member 107 provided movably in a body with the restricting guide 103*b*. A saw-like teeth portion 107*a* is formed at an end of the lock member 107. The move of the restricting guide 103*b* is locked when the teeth portion 17*a* engages with the teeth of the lock rail 106 (see FIG. 5A).

The lock member 107 is provided turnably centering on a shaft 109, and the teeth portion 107*a* is biased by a lock spring 108 in a direction of engaging with the teeth of the lock rail 106 (in a direction of an arrow C in FIG. 4A). Still further, the lock member 107 is linked with a releasing lever 104 projecting above the restricting guide 103*b*. The lock member 107 is configured to be turnable centering on the shaft 109 when the releasing lever 104 is manipulated. Accordingly, when the user manipulates the releasing lever 104, the lock member 107 turns while resisting against the bias force of the lock spring 108, the teeth portion 107*a* separates from the teeth of the lock rail 106, and the engagement is released (see FIG. 5B). Thereby, the lock of the restricting guide 103*b* is released and the restricting guide 103*b* becomes movable. When the releasing lever 104 is released after moving the restricting guide 103*b*, the lock member 107 turns by the bias force of the lock spring 108 and the teeth portion 107*a* engages with the teeth of the lock rail 106, so that the restricting guide 103*b* is locked so as not to be moved unintentionally.

Retract Portion

The sheet detecting device 45 of the present embodiment is provided with a retract portion 123 interlocked with the manipulation of the move of the restricting guide 103*b* and retracting the detecting member 101 from the sheet detecting position. As shown in FIG. 4A, the retract portion 123 includes a link member 105 integrally formed with the detecting member 101. The link member 105 turns in a body with the detecting member 101 centering on the turning shaft 111. As shown in FIGS. 5A and 5B, the link member 105 extending in the sheet width direction is formed so as to extend across an entire range of a moving area of the restricting guide 103*b*. Then, an arm portion 107*b* is formed at an end of the lock member 107 opposite from the side where the teeth portion 107*a* is provided. This arm portion 107*b* is formed to be engageable with the link member 105.

When the lock member 107 turns counterclockwise centering on the shaft 109 from the state shown in FIG. 4A in response to the manipulation of the releasing lever 104, the arm portion 107*b* presses down the link member 105 and the detecting member 101 turns clockwise centering on the turning shaft 111 as shown in FIG. 4B. Thereby, the detecting member 101 moves from the sheet detecting position to the retracting position (second position).

Meanwhile, when the user releases the releasing lever 104, the lock member 107 turns by the bias force of the lock spring 108 and the detecting member 101 turns by the bias force of the spring member 110, respectively, returning to the state shown in FIG. 4A.

Sheet Setting Operation

Actions of the respective components taken place in setting a sheet on the sheet stacking portion 102 constructed as described will be described.

As shown in FIG. 3A, in setting the sheet on the sheet stacking portion 102, the user moves the restricting guide 103*b* toward outside in the width direction in order to stack the sheet on the sheet stacking portion 102 and inserts the sheet in the direction of the arrow Z. Then, the user moves the sheet in the direction of the arrow A and abuts the left edge of the sheet against the fixed restricting guide 103*a*. Then, the user sets the sheet by moving the restricting guide 103*b* toward the restricting guide 103*a* so that the restricting guide 103*b* abuts against the right edge of the sheet.

Here, in response to the manipulation of the releasing lever 104 in moving the restricting guide 103*b*, the lock member 107 turns counterclockwise centering on the shaft 109 and the lock is released as shown in FIGS. 4B and 5B. At this time, the arm portion 107*b* presses down the link member 105. Thereby, the detecting member 101 turns clockwise centering on the turning shaft 111 and the detecting member 101 moves to the retracting position. As a result, the detecting member 101 retracts to the position where the detecting member 101 is not in contact with the sheet S even if the sheet S is set from the direction of the arrow A.

Still further, in the state in which the lock of the restricting guide 103*b* is released, the detecting sensor 112 is blocked by the detecting member 101 and detects that the sheet S is not present. Therefore, the sheet feeding unit 100 will not be actuated.

In response to the release of the releasing lever 104 after setting the sheet by moving the restricting guide 103*b*, the lock member 107 is biased by the lock spring 108 and the teeth portion 107*a* of the lock member 107 engage with the teeth of the lock rail 106 as shown in FIGS. 4C and 5A. Thereby, the move of the restricting guide 103*b* is locked.

Still further, if the releasing lever 104 is not manipulated any longer, the link member 105 is not also pressed by the arm portion 107*b* any longer. Thereby, the detecting member 101 turns in a direction of an arrow B by being biased by the spring member 110 and stops at a third position where the detecting member 101 abuts against the sheet whose front edge is set as shown in FIG. 4C. At this time, because the detecting sensor 112 is not blocked by the detecting member 101, the detecting sensor 112 detects that the sheet S is present. In the sheet detecting condition, the sheet feeding unit 100 is operable right away in response to a job signal.

Supposing here that the detecting member 101 does not move to the retracting position and is kept at the suspension state (first position) in setting the sheet, the side edge of the sheet abuts against the detecting member 101 being suspended when the sheet is moved in the direction of the arrow A. Then, because the detecting member 101 does not turn even if the sheet is set, there is a case when the detection of the sheet is not made. Still further, if the sheet is pressed strongly against the detecting member 101, there may be a case when the sheet is damaged. This kind of problem remarkably occurs when stiffness of the sheet is low or when size of the sheet is small in particular. In case no countermeasure is taken, it becomes necessary to set the sheet such that the sheet is inserted in the direction of the arrow Z after steadily abutting the left edge of the sheet against the restricting guide 103*a*, ending up limiting the sheet setting method.

Whereas, according to the present embodiment, the detecting member 101 retracts while interlocking with the lock releasing operation of the restricting guide 103*b* in setting the sheet. Therefore, even if the sheet S is set on the sheet stacking portion 102 from the sheet width direction, the sheet S will not be caught by the detecting member 101. Therefore, this arrangement makes it possible to prevent the sheet from being damaged, to eliminate necessity of resetting the sheet, or to prevent the sheet from being incorrectly detected. Still further, even if the sheet is caught by the detecting member 101 in abutting the left edge of the sheet against the restricting guide 103*a*, at least the detecting member 101 retracts to the retracting position in moving the restricting guide 103*b* to the restricting guide 103*a*. Therefore, even in such a case, the sheet is pressed by the restricting guide 103*b* and moves in the direction of the arrow A. Thus, the left edge of the sheet abuts against the restricting guide 103*a* and the right edge is restricted by the restricting guide 103*b*.

Second Embodiment

The case in which the center of turn of the detecting member 101 is located above the sheet surface set on the sheet stacking portion 102 and the detecting member 101 is suspended has been shown in the first embodiment described above. Next, a case in which the center of turn of the detecting member is disposed below the sheet surface to be set will be shown as a second embodiment. It is noted that the components having the same or corresponding functions with those of the first embodiment will be denoted by the same reference numerals.

Figure 6:
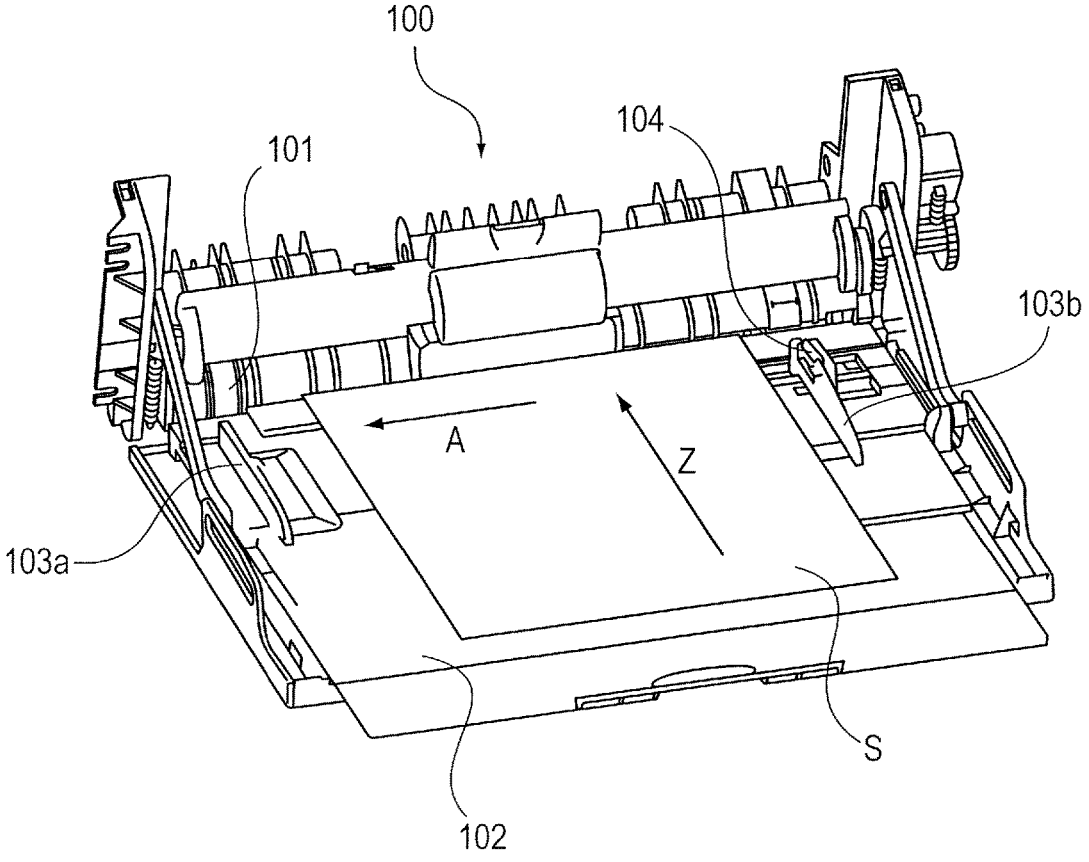
FIG. 6 is a perspective view of a sheet feeding unit of a second embodiment.
Figure 7A:
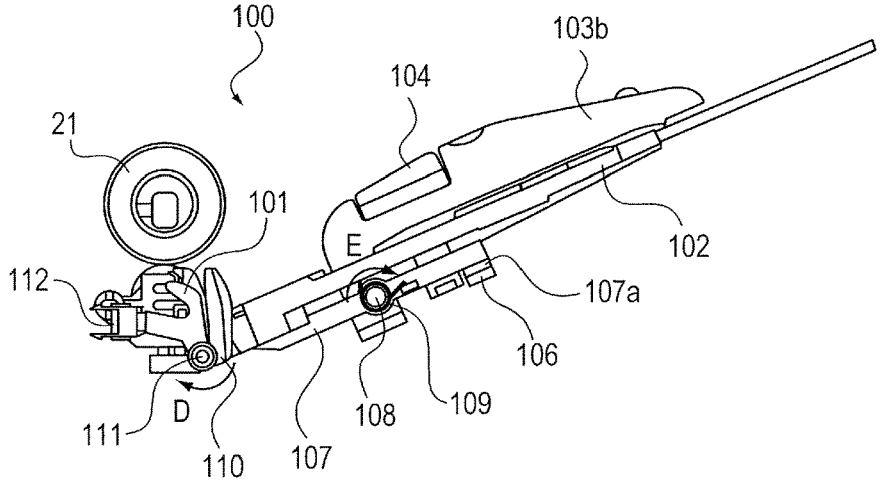
FIG. 7A is a section view of the sheet feeding unit in a state in which a sheet is not stacked on the sheet stacking portion.
Figure 7B:
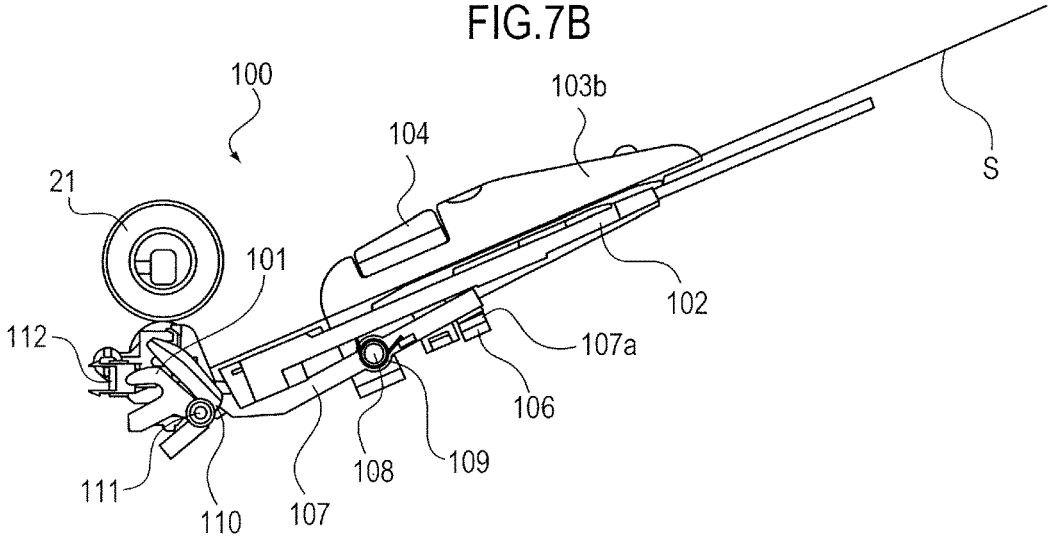
FIG. 7B is a section view of the sheet feeding unit in moving the restricting guide.
Figure 7C:
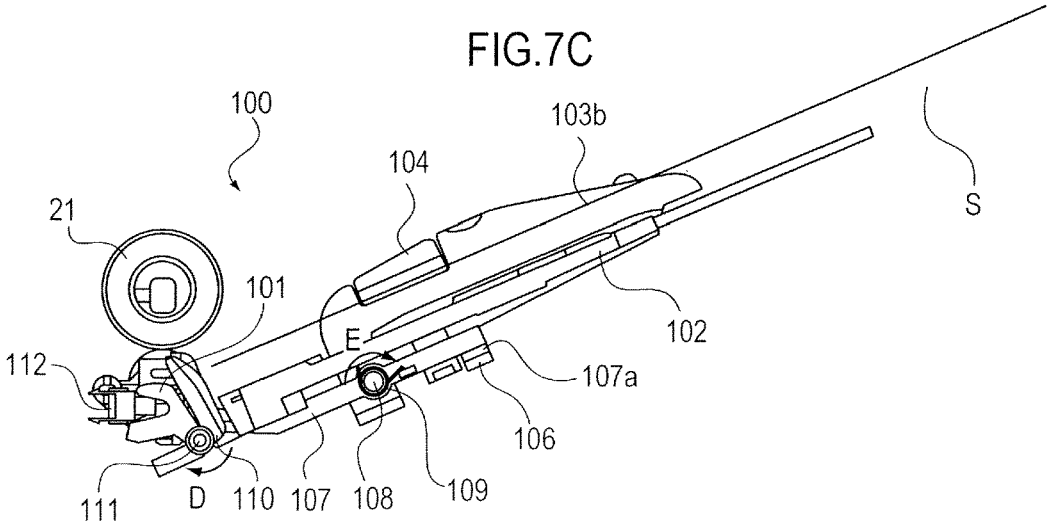
FIG. 7C is a section view of the sheet feeding unit in a state in which the sheet is stacked on the sheet stacking portion.

FIG. 6 is a partial perspective view of a sheet feeding unit 100 of a second embodiment. FIG. 7A is a section view of the sheet feeding unit 100 and illustrates a positional relationship between the detecting member 101 and the detecting sensor 112 when the detecting member 101 detects that no sheet is present. FIG. 7B illustrates the positional relationship between the detecting member 101 and the detecting sensor 112 in moving the sheet width restricting portion 103 in the sheet width direction in setting the sheet S on the sheet stacking portion 102. FIG. 7C illustrates the positional relationship between the detecting member 101 and the detecting sensor 112 when setting of the sheet S on the sheet stacking portion 102 is completed and the detecting sensor 112 detects that the sheet S is present on the sheet stacking portion 102.

In the state in which no sheet is present on the sheet stacking portion 102 of the sheet feeding unit 100, the detecting member 101 is turnable centering on the shaft 111 and is located at the first position where the detecting member 101 abuts with the sheet stacking portion 102 by being biased in a direction of an arrow D by the spring member 110. At this time, the detecting sensor 112 is blocked by the detecting member 101 and detects that no sheet is present on the sheet stacking portion 102, so that the sheet feeding unit 100 is not actuated. Still further, the lock member 107 is biased in a direction of an arrow E by the lock spring 108 centering on the shaft 109 at this time.

Figure 9A:
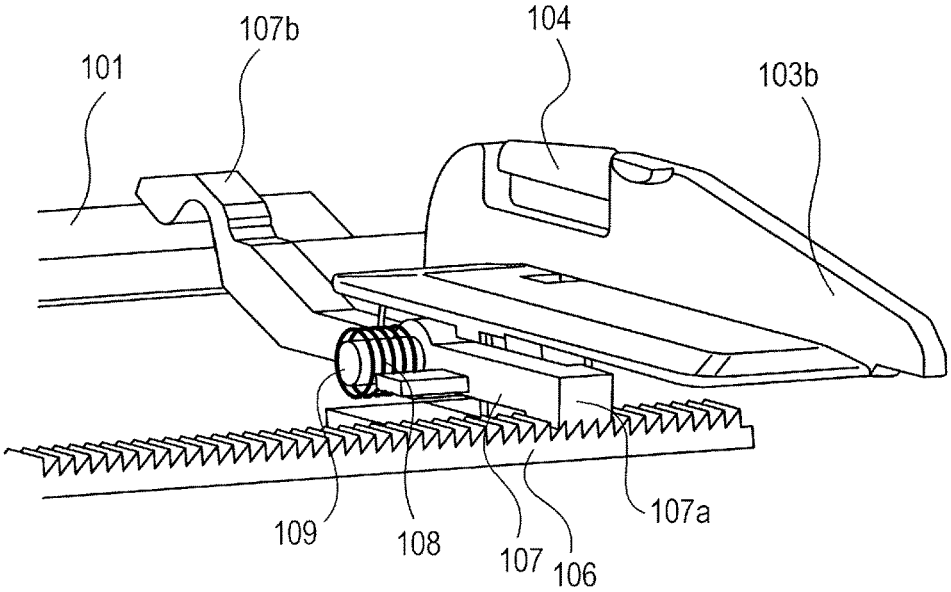
FIG. 9A illustrates the restricting guide being locked.

Still further, because the lock member 107 is biased by the lock spring 108, and the teeth of the lock rail 106 and the teeth portion 107*a* of the lock member 107 engage with each other, i.e., lock with each other, as shown in FIG. 9A, the restricting guide 103*b* is immovable.

Sheet Setting Operation

Figure 8A:
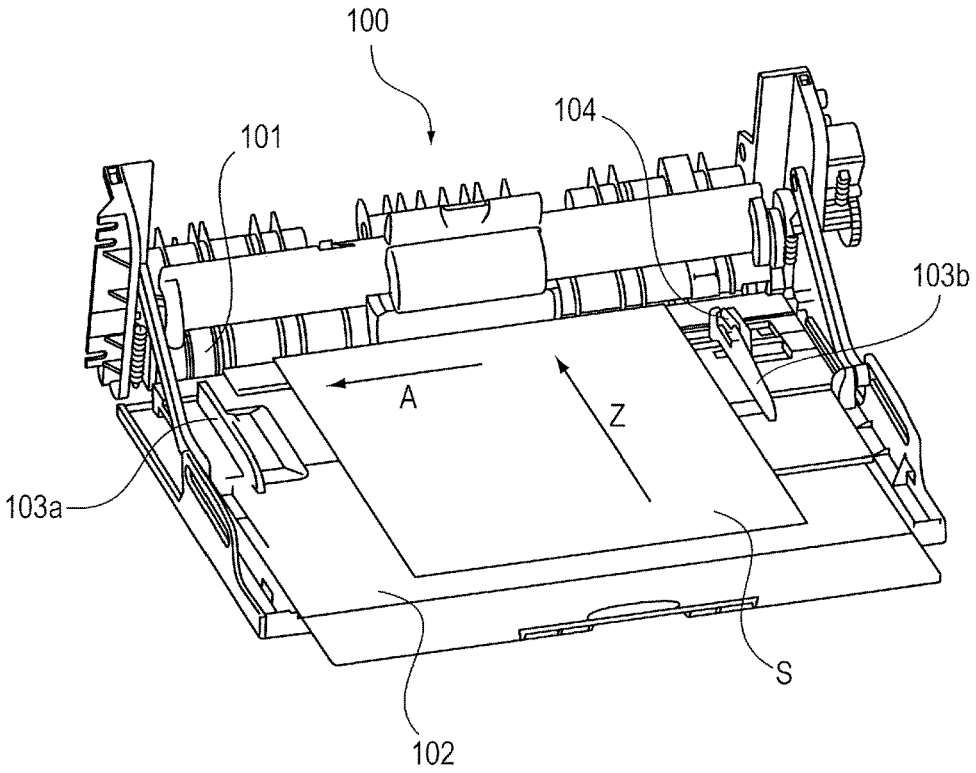
FIG. 8A illustrates an operation in setting the sheet on the sheet stacking portion.
Figure 8B:
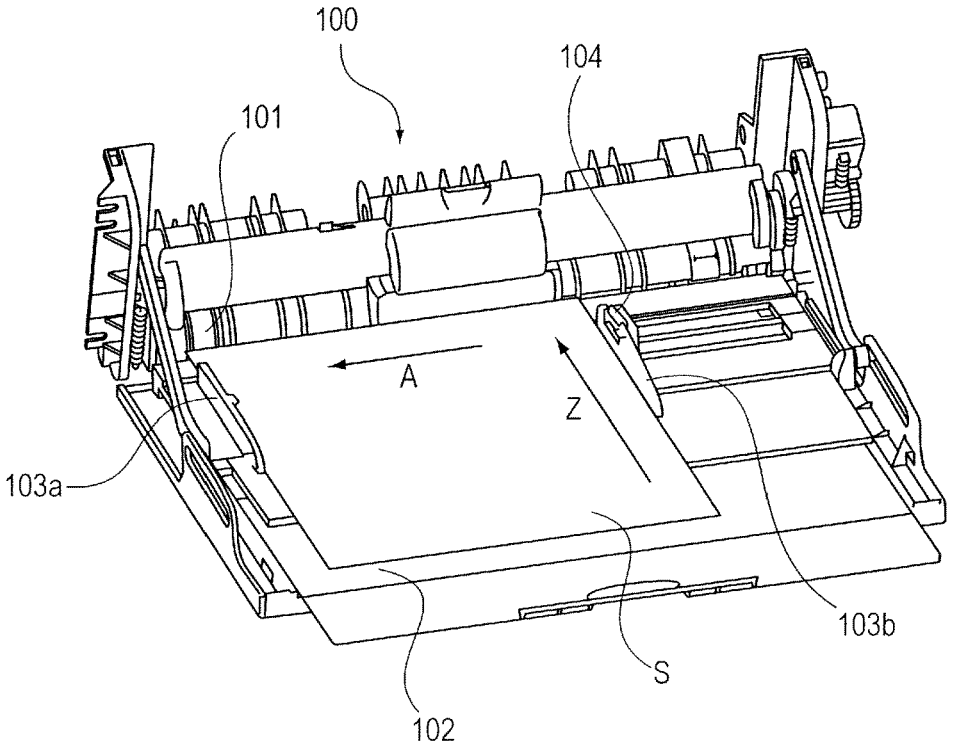
FIG. 8B illustrates the sheet stacking portion in the state in which the sheet is set.

In setting a sheet on the sheet stacking portion 102, the sheet is inserted in the direction of the arrow Z (the sheet conveying direction) and is then moved in the direction of the arrow A (the sheet width direction) such that the left edge of the sheet abuts against the fixed restricting guide 103*a* as shown in FIGS. 8A and 8B. Then, the restricting guide 103*b* is moved so as to abut against the right edge of the sheet and to position the sheet.

Figure 9B:
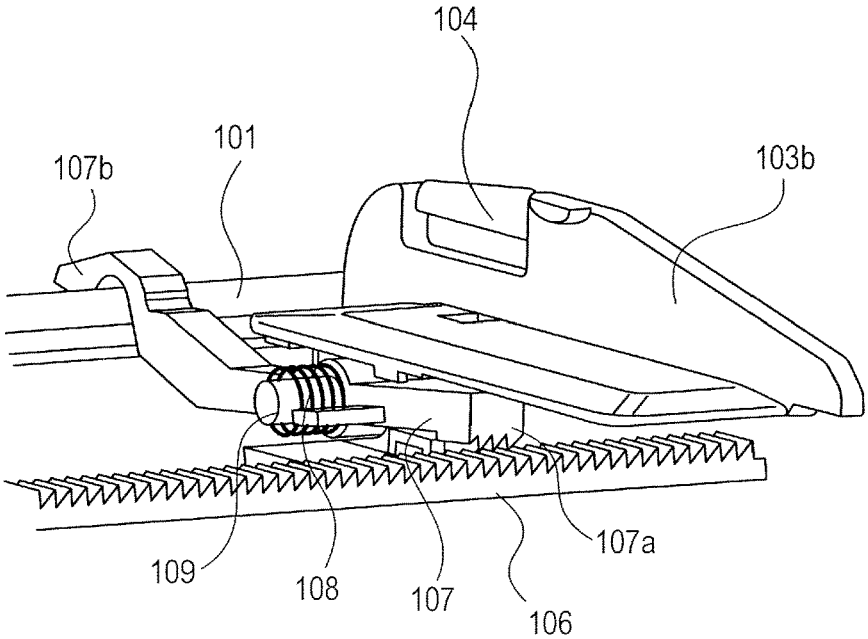
FIG. 9B illustrates the restricting guide being unlocked.

While the lock member 107 is biased in the direction of the arrow E by the lock spring 108 centering on the shaft 109 as shown in FIGS. 7A and 7B in the sheet setting operation, the lock member 107 is configured to be pressed in a releasing direction by resisting against the bias force by manipulating the releasing lever 104. As a result, the teeth portion 107*a* of the lock member 107 and the engaged teeth of the lock rail 106 separate from each other as shown in FIG. 9B, the lock of the lock member 107 and the lock rail 106 is released, and the restricting guide 103*b* becomes movable in the direction of the arrow A in FIG. 8A.

Still further, at this time, the lock member 107 pressed by the releasing lever 104 presses the detecting member 101 centering on the shaft 111 of the detecting member 101 by resisting against the bias force of the spring member 110 as shown in FIG. 7B.

As a result, the detecting member 101 retracts to the retracting position (second position) where the detecting member 101 will not be in contact with the sheet S even if the sheet S is set from the direction of the arrow A.

At this time, the detecting sensor 112 is blocked by the detecting member 101 and detects that no sheet is present on the sheet stacking portion 102. Therefore, the sheet feeding unit 100 will not enter a feeding operation during when the restricting guide 103*b* is moved to set the sheet S on the sheet stacking portion 102.

Then, when the restricting guide 103*b* is moved and setting of the sheet is completed, the lock member 107 turns in the direction of the arrow E centering on the shaft 109 by being biased by the lock spring 108 as shown in FIG. 7C. Thereby, the teeth of the lock rail 106 engage with the teeth portion 107*a* of the lock member 107 and the restricting guide 103*b* is locked and immobilized.

In the state in which the sheet S is set on the sheet stacking portion 102 of the sheet feeding unit 100 as described above, the detecting member 101 is biased in the direction of the arrow D centering on the shaft 111 by the spring member 110 as shown in FIG. 7C. At this time, the detecting member 101 abuts against the sheet S set on the sheet stacking portion 102, so that the detecting member 101 is located at the third position.

At this time, the detecting sensor 112 is not blocked by the detecting member 101 and detects that the sheet S is present on the sheet stacking portion 102, so that the sheet feeding unit 100 is put into a condition shiftable to the feed operation as soon as a job is inputted.

As described above, the detecting member 101 retracts by interlocking with the manipulation of the restricting guide 103*b* even if the sheet S is stacked on the sheet stacking portion 102 from the sheet width direction in the configuration in which the center of turn of the detecting member 101 is disposed below the sheet S. Accordingly, it is possible to prevent the sheet S from being damaged and the non-detecting state from occurring otherwise caused when the sheet S is caught by the detecting member 101.

Third Embodiment

Next, a sheet feeding unit of a third embodiment will be described with reference to FIGS. 10 through 13. It is noted that in the present embodiment, a configuration of a sheet detecting device 200 detecting a sheet in the sheet feeding unit is mainly different from the image forming apparatus of the first embodiment. Therefore, components of the present embodiment having the same or corresponding functions with those of the first embodiment will be denoted by affixing 'X' in the end of the same reference numerals and an explanation thereof will be omitted here.

Figure 10:
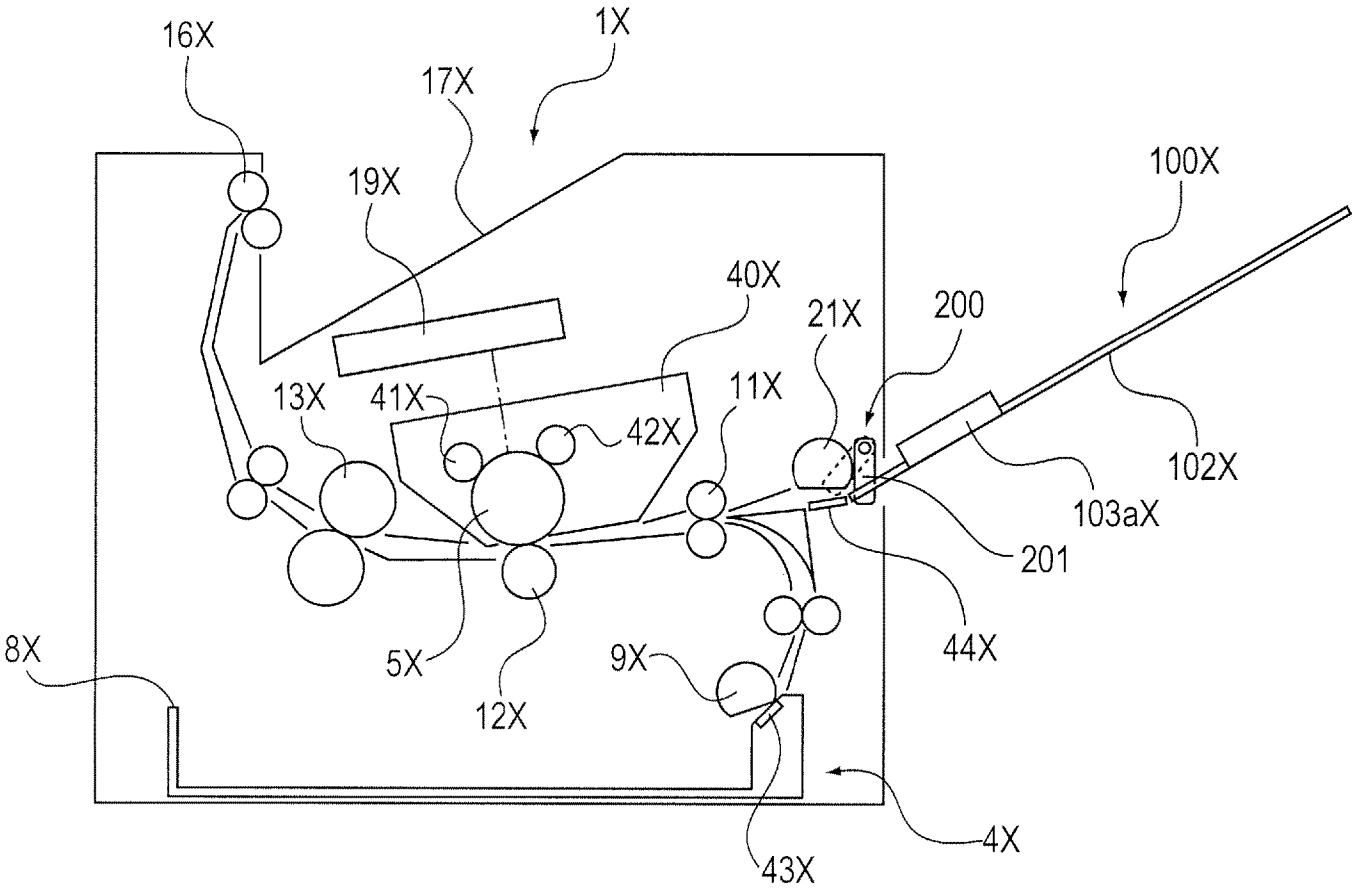
FIG. 10 is a schematic diagram (section view) illustrating a configuration of an image forming apparatus of a third embodiment.
Figure 12A:
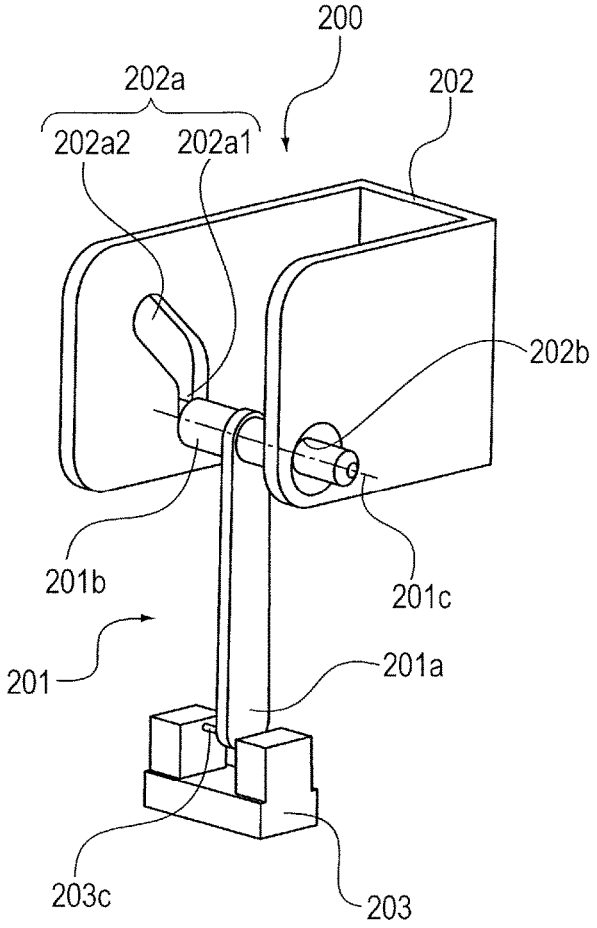
FIG. 12A is a perspective view illustrating a sheet detecting device of the third embodiment.

FIG. 10 illustrates the image forming apparatus 1X of the present embodiment and includes a manual sheet feeding unit 100X similarly to the image forming apparatus of the embodiments described above. As shown in FIG. 12A, the sheet detecting device 200 includes a sheet detecting lever (simply referred to as a 'detecting lever' hereinafter) 201, a supporting member 202 supporting the sheet detecting lever 201, and a sheet detecting sensor 203 detecting whether or not a sheet is present through the sheet detecting lever 201.

Figure 11A:
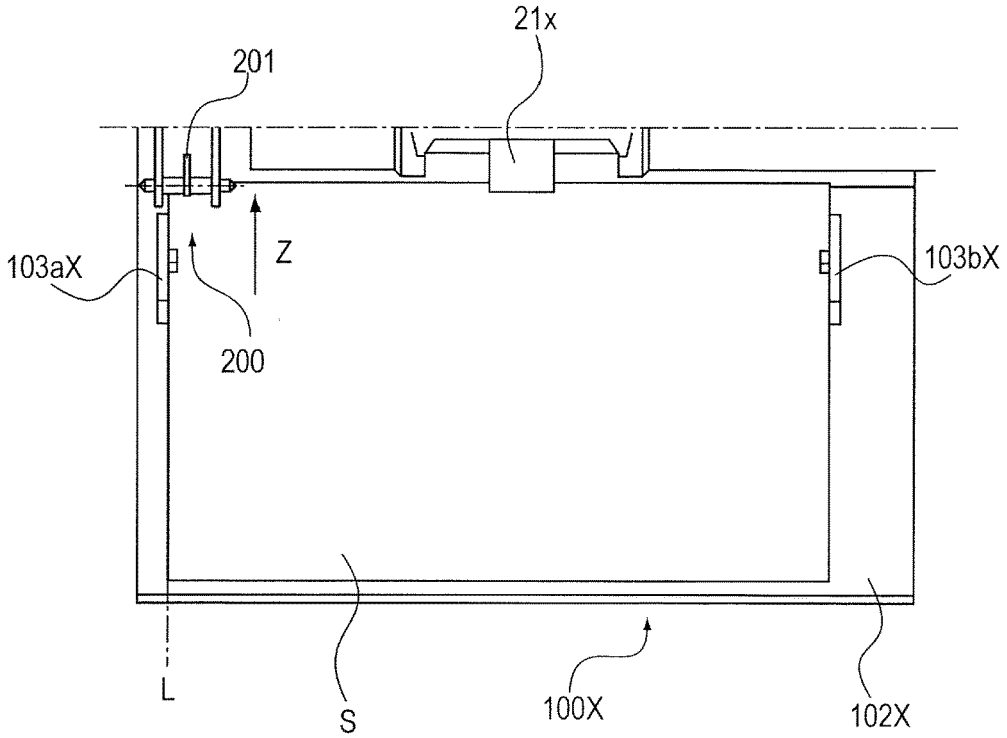
FIG. 11A illustrates a configuration of the sheet feeding unit in which the sheet is correctly set.
Figure 11B:
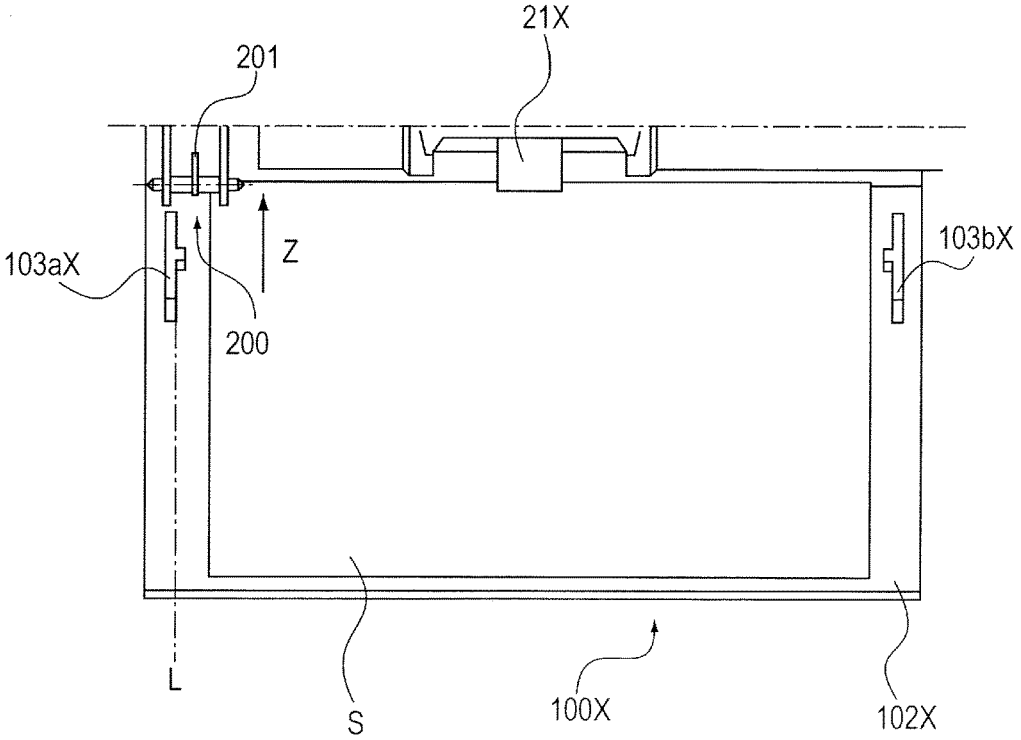
FIG. 11B illustrates the configuration of the sheet feeding unit in which the sheet is incorrectly set.

Still further, as shown in FIGS. 11A and 11B, side restricting plate (sheet width restricting portion) 103*a*X and 103*b*X restricting and aligning the sheet widthwise position are configured such that the one (left) side restricting plate 103X is fixed and the other (right) side restricting plate 103*b*X is movable in the width direction with respect to the fixed side restricting plate 103*a*X also in the present embodiment. The sheet detecting device 200 is disposed in the vicinity of the side restricting plate 103*a*X that abuts with an edge of a sheet and is a reference, i.e. a reference portion, in setting the sheet, and within a sheet stacking area so as to be able to reliably detect even a small-size sheet.

Sheet Detecting Device

Figure 12B:
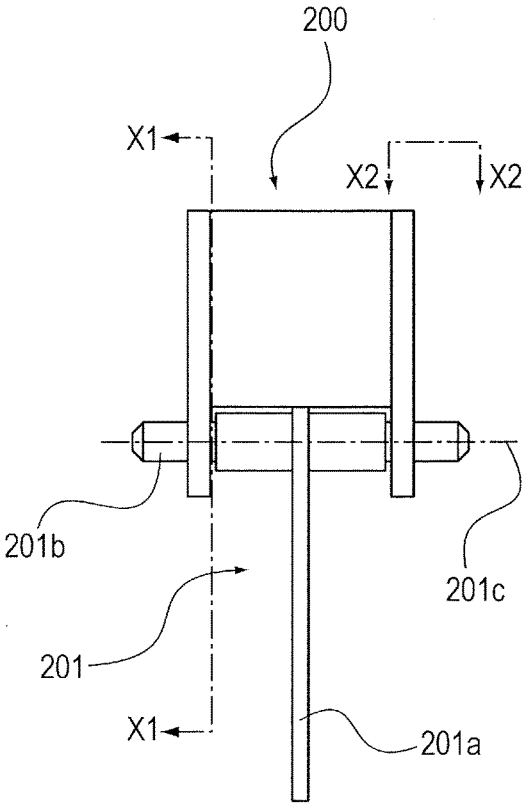
FIG. 12B is a front view of the sheet detecting device of the third embodiment.
Figure 12C:
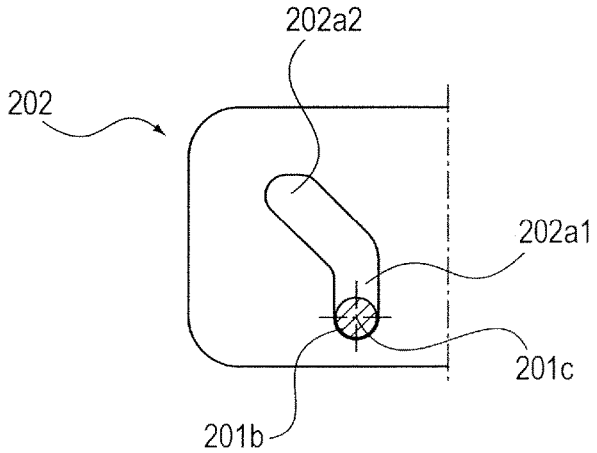
FIG. 12C is a section view of the sheet detecting device of the third embodiment taken along a line X1-X1 in FIG. 12B.

In succession, the configuration of the sheet detecting device 200 will be described in detail with reference to FIGS. 12A through 12D. FIG. 12A is a perspective view of the sheet detecting device 200, FIG. 12B is a front view of the sheet detecting device 200, FIG. 12C is a section view of the sheet detecting device 200 taken along a line X1-X1 in FIG. 12B, and FIG. 12D is a section view of the supporting member 202 taken along a line X2-X2 in FIG. 12B.

As shown in FIG. 12A, both end portions of a rotational shaft 201*b* of the sheet detecting lever 201, i.e., a movable member, are supported by supporting holes 202*a* and 202*b*, i.e., supporting portions of the supporting member 202, such that the sheet detecting lever 201 is turnable centering on the rotational shaft 201*b* in the sheet detecting device 200 of the present embodiment. Then, among the supporting holes 202*a* and 202*b* supporting the both ends of the rotational shaft 201*b*, the supporting hole 202*a*, i.e., a first supporting portion, located outer side of the body of the sheet feeding unit 100 (outer side in the sheet width direction: simply referred to as the 'body outer side' hereinafter) in the sheet width direction, i.e., a second direction, orthogonal to a sheet feeding direction, i.e., a first direction, is formed as shown in FIG. 12C. That is, this supporting hole (first supporting portion) 202*a* is formed into a complex long hole shape in which a long hole 202*a*1 extending vertically upward from a supporting position where the rotational shaft 201*b* is turnably supported is combined with a long hole 202*a*2 which extends obliquely upstream in the sheet feeding direction from the long hole 202*a*1. Thereby, one end portion of the rotational shaft 201*b* is allowed to move to a side opposite from the sheet feeding direction by moving along the long hole (first hole) 202*a*2.

Figure 12D:
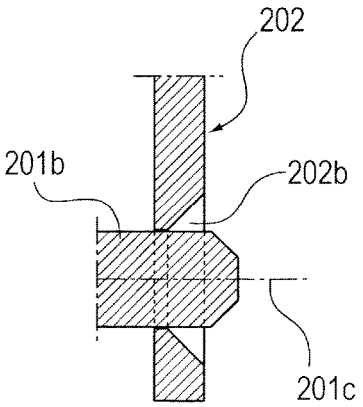
FIG. 12D is a section view of a supporting member taken along a line X2-X2 in FIG. 12B.

Still further, the supporting hole 202*b*, i.e., a second supporting portion, located at the body inner side (inside in the sheet width direction) among the supporting holes of the supporting member 202 is formed into a circular mortar shape whose hole diameter changes in a direction of the rotational shaft of the sheet detecting lever 201 as shown in FIG. 12D. It is noted that the hole diameter of the mortar shape of the supporting hole (second supporting portion) 202*b* is formed such that an inner hole diameter is larger than an outer hole diameter such that the closer the body inner side in the sheet width direction, the larger the hole diameter becomes in the direction of the rotational shaft of the sheet detecting lever 201. It is noted that the first supporting portion 202*a* is provided outside in a sheet width direction more than the second supporting portion 202*b*.

When the sheet detecting lever 201 is attached to such supporting member 202, the rotational shaft 201*b* of the sheet detecting lever 201 is supported such that one end portion thereof is supported to a lower end of the long hole 202*a*1 of the supporting member 202 and another end portion is supported by the circular supporting hole 202*b* of the supporting member 202. In this state, the rotational shaft 201*b* is supported while having fitting backlash in the sheet feeding direction Z. At this time, a direction of the rotational shaft 201*b* of the sheet detecting lever 201 coincides with the sheet width direction A, and if a sheet S is appropriately placed along the sheet feeding direction Z, the sheet detecting lever 201 turns in the sheet feeding direction Z from a standby position by being pressed by the sheet on the basis of the rotational shaft 201*b*. Still further, in a state in which no sheet S is placed, the light blocking portion (detected part) 201*a* of the sheet detecting lever 201 is supported in a state (standby state) in which the light blocking portion 201*a* is suspended vertically downward by its own weight. That is, the sheet detecting lever 201 as the moving member includes the rotational shaft 201*b* at an upper part thereof and the detected part 201*a* provided below the rotational shaft and detected by the detecting sensor. Therefore, the light blocking portion 201*a* blocks an optical axis 203*c* of the sheet detecting sensor (lever detecting portion, detecting sensor) 203 composed of a photo interrupter by a front end of the light blocking portion 201*a* (see FIG. 12A). It is noted that the sheet detecting lever 201 may be positioned at the standby position by an elastic force of an elastic member for example other than the configuration utilizing the own weight like the present embodiment in order to position the sheet detecting lever 201 at the standby position.

Operation when Detecting Lever Receives Force in Sheet Width Direction

Next, actions of the detecting lever 201 taken place when the sheet detecting lever 201 receives a force in the sheet width direction A will be described with reference to FIGS. 13A through 13E. FIGS. 13A through 13E illustrate the actions of the sheet detecting lever 201, in order of time series, taken place when the sheet detecting lever 201 is pushed from the body inner side to the body outer side in the sheet width direction. Here, a turning direction of the detecting lever 201 will be indicated by 'R' and moving directions of the sheet detecting lever 201 in the order of time series will be indicated by X1, X2, and X3, respectively.

Figure 13A:
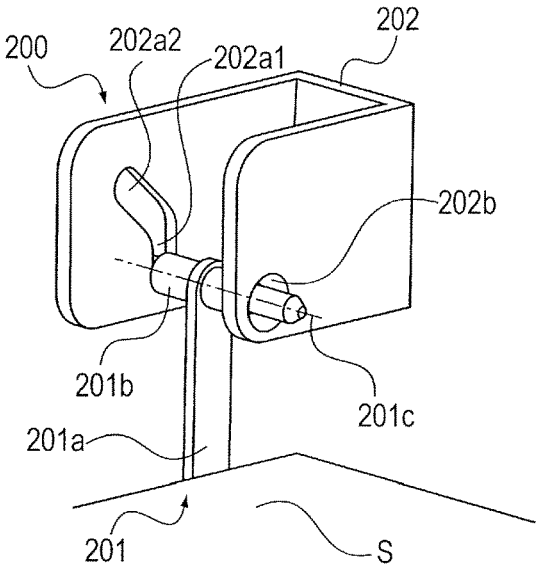
FIG. 13A illustrates the sheet detecting device of the third embodiment in a state in which the sheet is in contact with the detecting lever in a sheet width direction.
Figure 13B:
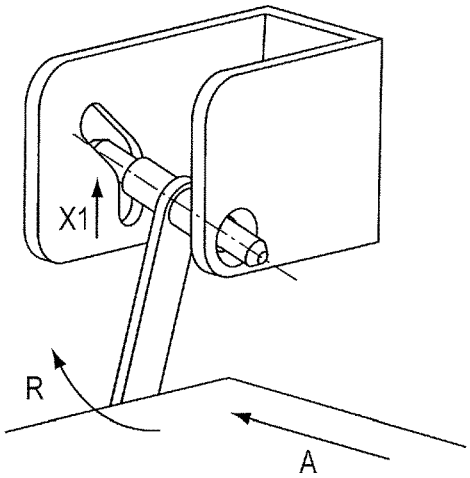
FIG. 13B illustrates the sheet detecting device in a state in which the sheet is moved further in the sheet width direction from the state shown in FIG. 13A.
Figure 13C:
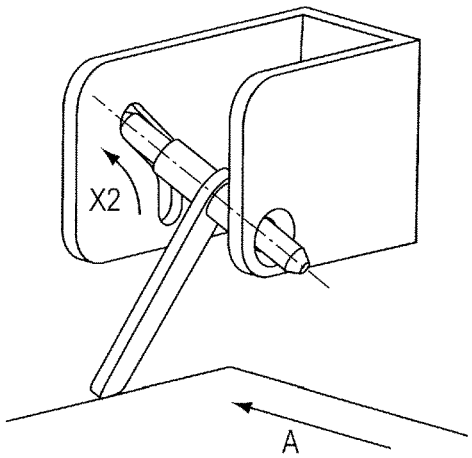
FIG. 13C illustrates the sheet detecting device in a state in which the sheet is moved further in the sheet width direction from the state shown in FIG. 13B.
Figure 13D:
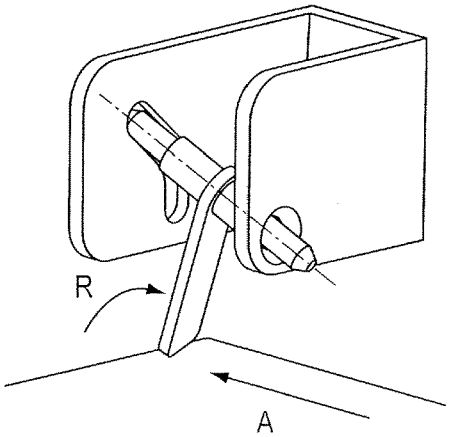
FIG. 13D illustrates the sheet detecting device in a state in which the sheet is moved further in the sheet width direction from the state shown in FIG. 13C.
Figure 13E:
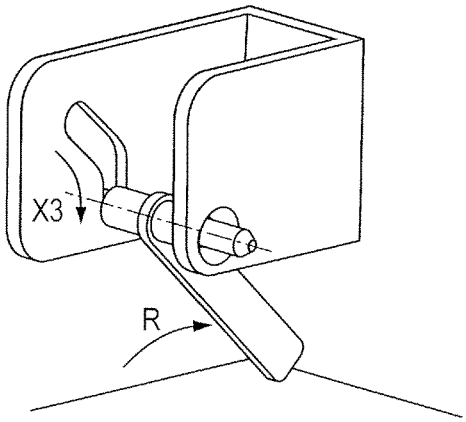
FIG. 13E illustrates the sheet detecting device in a state in which the detecting lever is moved to a sheet detecting position.

When the sheet S comes into contact with a side edge of the sheet detecting lever 201 in the sheet width direction A (FIG. 13A), one end of the body outer side of the rotational shaft 201*b* is lifted up (in a direction of X1) along the long hole 202*a*1 of the supporting portion as shown in FIG. 13B and the rotational shaft 201*b* is inclined in the direction R (first action). Next, the one end of the body outer side of the rotational shaft 201*b* inclines obliquely upward (in a direction of X2) upstream in the sheet feeding direction along the long hole 202*a*2 of the supporting portion (second action) as shown in FIG. 13C. Still further, the light blocking portion 201*a* turns in the sheet feeding direction (the direction R) around the inclined rotational shaft 201*b* (third action) as shown in FIG. 13D. Finally, when the front end of the sheet detecting lever 201 is placed on the sheet, the rotational shaft 201*b* moves downward (in a direction of X3) within the long holes 202*a*2 and 202*a*1, and drops to a lower part of the long hole 202*a*1, i.e., an initial supporting position, by own weight of the detecting lever 201. In other words, one end of the rotational shaft supported by the long first hole turns by a first action of inclining upward along the long hole shape, a second action of inclining upstream in the sheet feeding direction, and a third action of turning in the sheet feeding direction when the moving member is pushed in the sheet width direction. It is noted that the turns in the directions of X1, X2, and X3 occur because the supporting hole 202*b* supporting the one end part of the rotational shaft 201*b* is formed into the mortar shape. Therefore, when the one end part of the rotational shaft 201*b* turns in a direction opposite to the sheet feeding direction, the other end part turns in the sheet feeding direction centering on a contact part of the supporting hole (second hole) 202*b*. Thereby, the rotational shaft 201*b* turns smoothly.

Due to the series of actions described above, the light blocking portion 201*a*, i.e., the front end of the sheet detecting lever 201, turns in the direction R, i.e., to the side of the sheet feeding direction Z, and a direction of the light blocking portion 201*a* coincides with a direction of the sheet feeding direction Z. That is, the sheet detecting lever 201 comes to the position which is the same position where the sheet detecting lever 201 is positioned when the sheet S is appropriately placed on the feed tray 113 from the sheet feeding direction. This means that the sheet detecting lever 201 can be turned to the appropriate position even if the sheet S is placed in the sheet width direction A.

Figure 17A:
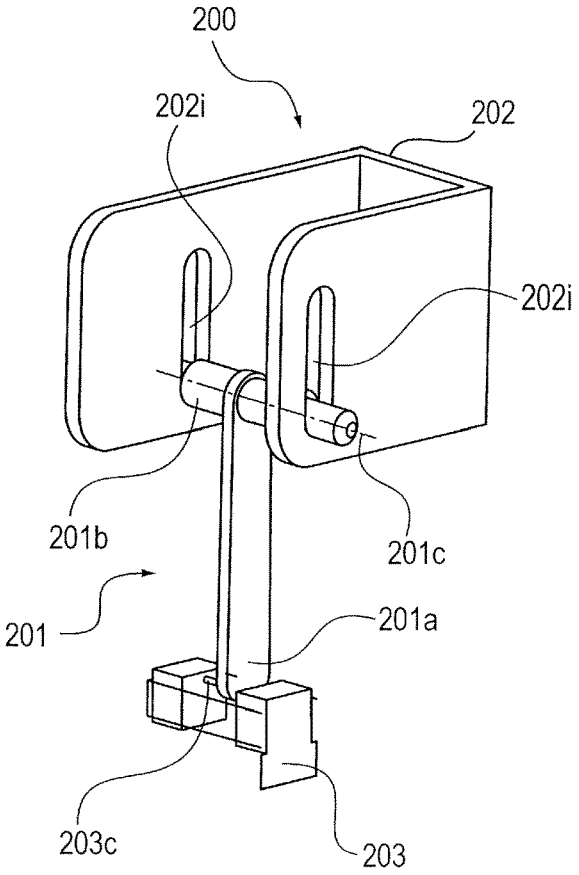
FIG. 17A is a perspective view illustrating a sheet detecting device of a comparative example.
Figure 17B:
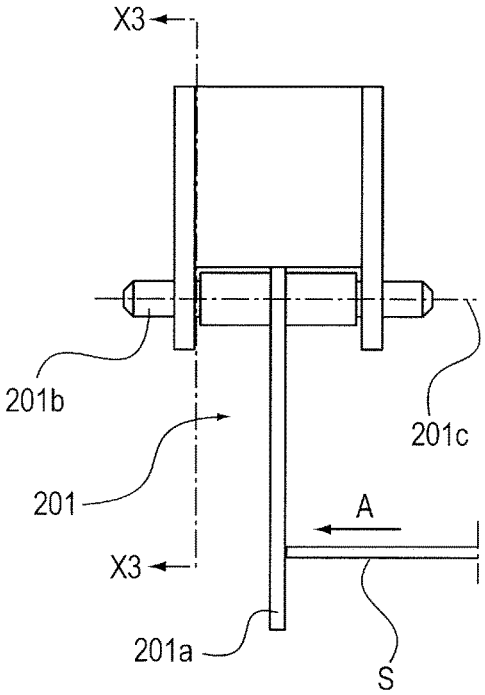
FIG. 17B is a front view of the sheet detecting device of the comparative example.
Figure 17C:
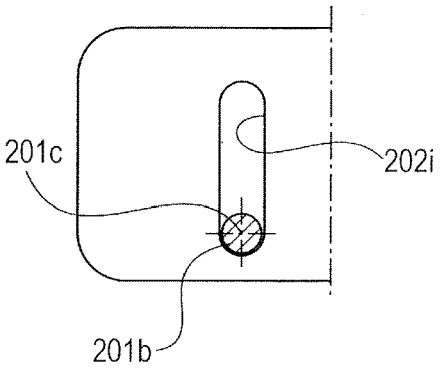
FIG. 17C is a section view of the sheet detecting device of the comparative example taken along a line X3-X3 in FIG. 17B.
Figure 17D:
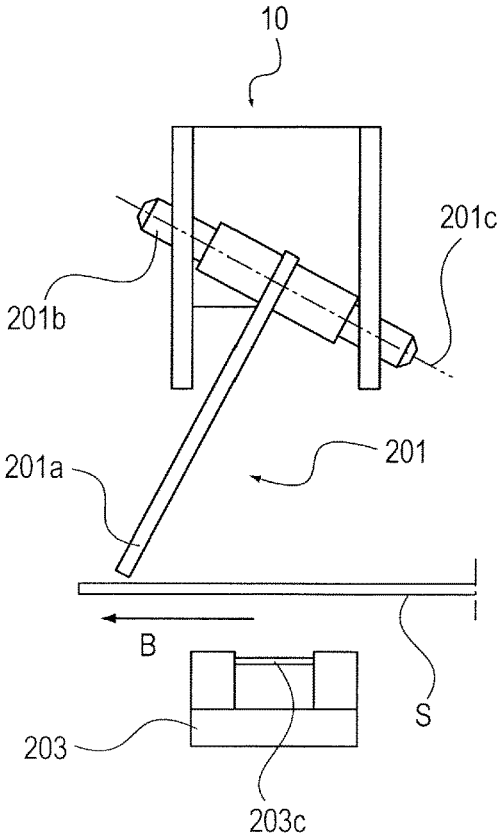
FIG. 17D is a front view illustrating the sheet detecting device in a case when a sheet is erroneously set.

That is, if the supporting holes of the supporting member supporting the sheet detecting lever 201 are formed into long holes straightly extending in the vertical direction orthogonal to the sheet feeding and sheet width directions as shown in FIGS. 17A through 17D for example, one end of the rotational shaft 201*b* and the light blocking portion 201*a* of the sheet detecting lever 201 incline and retract upward if a force in a direction B orthogonal to the sheet feeding direction is applied to the light blocking portion 201*a* of the sheet detecting lever 201 due to the sheet S as shown in FIG. 17D. Even in such a case, the optical axis 203*c* of the sheet detecting sensor 203 is released from being blocked and it is possible to detect the sheet S on the feed tray 113 even if the sheet S is placed in a wrong direction.

However, even though it is possible to retract the sheet detecting lever 201 upward when the force in the sheet width direction A is applied, it is unable to turn in the sheet feeding direction Z by the configuration in which the sheet detecting lever 201 is supported by the supporting member 202 having the long holes in the vertical upward direction as shown in FIGS. 17A through 17D. Accordingly, if a feed is started in the state in which the sheet detecting lever 201 is retracted as described above, the sheet detecting lever 201 inclined as shown in FIG. 17D may interfere conveyance of a sheet, possibly unstabilizing the feed of the sheet.

As compared to the sheet detecting lever 201 shown in FIGS. 17A through 17D, because the sheet detecting device 200 of the present embodiment is configured such that the sheet detecting lever 201 is turnable in the two directions of the sheet width direction A and the sheet feeding direction Z when the force in the sheet width direction A id applied to the sheet detecting lever 201, the sheet detecting lever 201 can turn to the appropriate position. Therefore, this arrangement makes it possible to detect a sheet set on the sheet stacking portion and to stably feed the sheet regardless of a method for stacking the sheet on the sheet stacking portion.

It is noted that in the series of actions of the sheet detecting lever 201 described above, the sheet detecting sensor 203 is configured such that a turning locus of the light blocking portion 201*a* does not interfere with a profile of the sheet detecting sensor 203. More specifically, it is possible to avoid the locus of the actions from interfering with the profile of the sheet detecting sensor 203 by optimizing a length of the light blocking portion 201*a* and a length of the sheet detecting lever 201 of the sheet detecting lever 201 depending on a type of the sheet detecting sensor 203 and a relationship with the sheet detecting lever 201. Still further, although the shape of the supporting hole 202*b* is formed such that the hole diameter changes in the direction of the rotational shaft 201*b* such that the rotational shaft 201*b* can smoothly move when the rotational shaft 201*b* moves in the present embodiment, the shape of the supporting hole 202*b* is not limited to the shape described above as long as the supporting hole 202*b* does not interfere the move of the rotational shaft 201*b*.

Fourth Embodiment

Next, a sheet detecting device of a fourth embodiment of the invention will be described with reference to FIG. 14.

Figure 14:
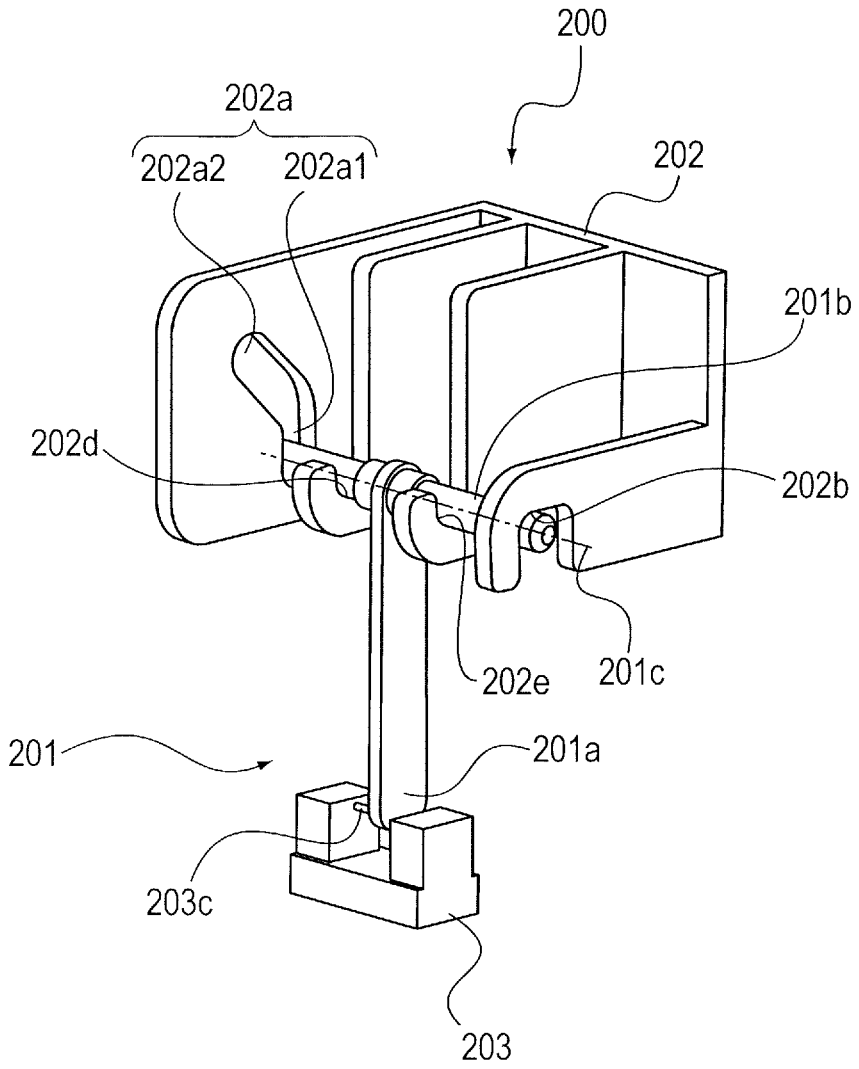
FIG. 14 is a perspective view illustrating a configuration of a sheet detecting device of a fourth embodiment.

While a basic configuration of the sheet detecting device of the fourth embodiment shown in FIG. 14 is the same with that of the third embodiment shown in FIG. 12A, shapes of supporting holes and a supporting method of the rotational shaft 201*b* are different from each other. Here, supporting portions 202*d* and 202*e* support around a middle part in an axial direction of the rotational shaft 201*b*.

According to the sheet detecting device of the fourth embodiment, the supporting hole 202*a* located at the body outer side in the sheet width direction among the supporting portions of the supporting member 202 supporting the rotational shaft 201*b* of the detecting lever 201 is formed into the same manner with the third embodiment. That is, as shown in FIG. 14, the supporting hole 202*a* is formed into a complex long hole shape in which a long hole 202*a*1 extending vertically upward is combined with a long hole 202*a*2 which extends obliquely upstream in the sheet feeding direction from the long hole 202*a*1. Then, other three supporting portions 202*b*, 202*d*, and 202*e* are formed into a shape of U in which a part of an outer edge of the supporting member 202 is cut away. Still further, the three supporting portions are formed into the shape of U respectively such that the supporting hole 202*b* located at the body inner side in the sheet width direction is cut away in a vertical downward direction and such that the supporting portions 202*d* and 202*e* located around the middle part are cut away in vertically upward direction.

When the detecting lever 201 is attached to such supporting member 202, one end portion of the rotational shaft 201*b* of the detecting lever 201 is supported by a lower end of the long hole 202*a* of the supporting member 202 and two points around the middle part thereof are supported by lower ends of the U-shaped supporting portions 202*d* and 202*e*. In this state, the rotational shaft 201*b* is supported while having fitting backlash in the sheet feeding direction Z. Still further, the rotational shaft 201*b* of the detecting lever 201 is supported in a state in which a vertical move thereof is restricted by an upper end of the supporting hole 202*b*. At this time, the direction of the rotational shaft 201*b* of the detecting lever 201 coincides with the sheet width direction, and when the sheet S is stacked appropriately along the sheet feeding direction, the detecting lever 201 turns in the sheet feeding direction Z on the basis of the rotational shaft 201*b*. Still further, in a state in which no sheet is stacked, the light blocking portion 201*a* of the detecting lever 201 is supported in a state of being suspended in the vertical downward direction and blocks the optical axis 203*c* of the sheet detecting sensor 203 by the front end thereof.

Actions of the detecting lever 201 taken place when the detecting lever 201 receives a force in the sheet width direction A are the same with those described in the third embodiment described above. Accordingly, it is possible to turn the detecting lever at the appropriate position even if the sheet S is stacked in the sheet width direction A also in the sheet detecting device shown in FIG. 14.

Fifth Embodiment

Next, a sheet detecting device of a fifth embodiment will be described with reference to FIGS. 15A through 15D. While a basic configuration of the sheet detecting device is the same with that of the third embodiment, shapes of supporting holes of the supporting member 202 are different from each other.

Specifically, among supporting holes supporting both ends of the rotational shaft 201*b*, a supporting hole 202*f* located at the body outer side in the sheet width direction is formed into a straight long hole (FIG. 15A) extending obliquely upward and upstream in the sheet feeding direction on the basis of the supporting portion of the rotational shaft 201*b*. Still further, a supporting hole 202*b* located at the body inner side in the sheet width direction among the supporting holes of the supporting member 202 is formed into a circular mortar shape whose diameter changes in the direction of the rotational shaft 201*b* similarly to one described in the third embodiment.

When the detecting lever 201 is attached to such supporting member 202, one end portion of the rotational shaft 201*b* of the detecting lever 201 is supported by a lower end of the supporting hole 202*f* of the supporting member 202 and another end portion is supported by the circular supporting hole 202*b* of the supporting member 202. In this state, the rotational shaft 201*b* is supported while having fitting backlash in the sheet feeding direction Z. The relationships between the detecting lever 201 and the sheet S and between the detecting lever 201 and the sheet detecting sensor 203 are the same with those already described in the third embodiment.

Next, actions of the detecting lever 201 taken place when the detecting lever 201 receives a force in the sheet width direction A will be described with reference to FIGS. 15A through 15D. FIGS. 15A through 15D illustrate the actions of the sheet detecting lever 201, in order of time series, taken place when the sheet detecting lever 201 receives the force in the sheet width direction A. Here, the turning direction of the detecting lever 201 is indicated by 'R' and the moving directions of the sheet detecting lever 201 in the order of time series will be indicated by X4 and X5.

Figure 15A:
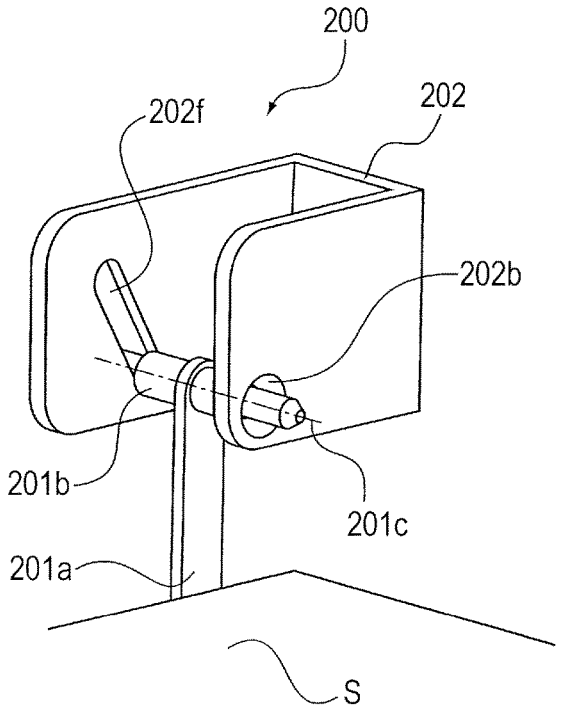
FIG. 15A illustrates a sheet detecting device of a fifth embodiment in a state in which a sheet is in contact with a detecting lever in the width direction.
Figure 15B:
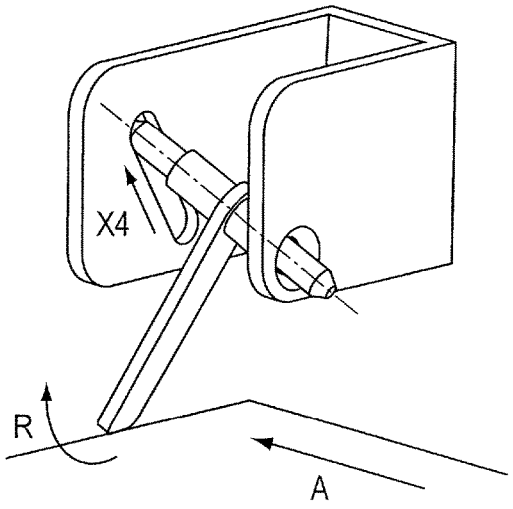
FIG. 15B illustrates the sheet detecting device in a state in which the sheet is moved further in the sheet width direction from the state shown in FIG. 15A.
Figure 15C:
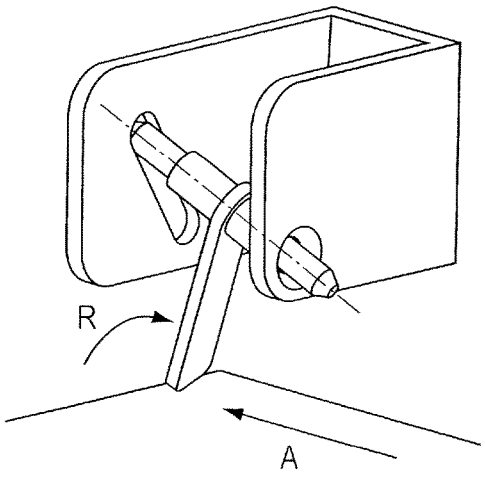
FIG. 15C illustrates the sheet detecting device in a state in which the sheet is moved further in the sheet width direction from the state shown in FIG. 15B.
Figure 15D:
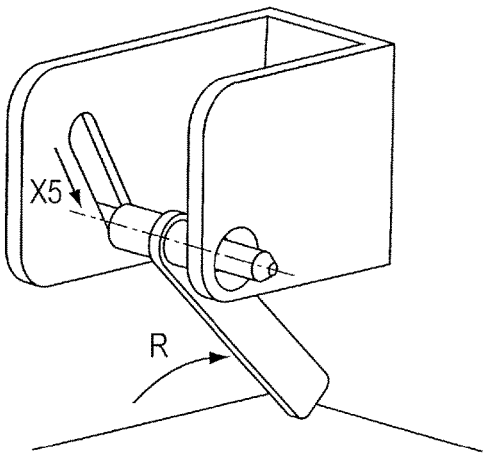
FIG. 15D illustrates the sheet detecting device in a state in which the detecting lever is moved to the sheet detecting position.

When the sheet S comes into contact with the side edge of the detecting lever 201 from the sheet width direction A (FIG. 15A), one end of the body outer side of the rotational shaft 201*b* of the detecting lever 201 is lifted up obliquely in the direction X4 along the supporting hole 202*f* of the supporting portion as shown in FIG. 15B. That is, the long hole is formed into a straight shape in which the hole extends upward and upstream in the sheet feeding direction. Thereby, the rotational shaft 201*b* is inclined in the direction R. In succession, when the front end of the detecting lever 201 is placed on the sheet surface as shown in FIG. 15C, the light blocking portion 201*a* turns in the direction R around the inclined rotational shaft 201*b*. Then, finally, the rotational shaft 201*b* moves within the long hole 202*f* of the detecting lever 201 in the direction X5 by own weight of the detecting lever 201 and drops to a lower part of the long hole 202*f*, i.e., an initial position. At this time, the light blocking portion 201*a*, i.e., the front end of the sheet detecting lever 201, turns in the direction R, i.e., to the side of the sheet feeding direction, and a direction of the light blocking portion 201*a* coincides with a direction of the sheet feeding direction Z. That is, the sheet detecting lever 201 comes to the position which is the same position where the sheet detecting lever 201 is positioned when the sheet S is appropriately placed on the feed tray 113 from the sheet feeding direction. This means that the sheet detecting lever 201 can be turned to the appropriate position even if the sheet S is placed in the sheet width direction A.

Sixth Embodiment

Figure 16A:
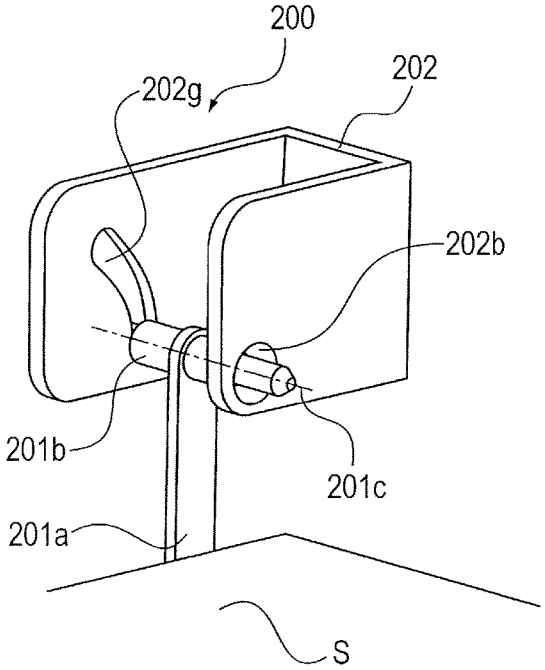
FIG. 16A illustrates a sheet detecting device of a sixth embodiment in a state in which a sheet is in contact with a detecting lever in the width direction.

In succession, a sheet detecting device of a sixth embodiment will be described with reference to FIGS. 16A through 16D. While a basic configuration of the sheet detecting device in FIGS. 16A through 16D is the same with that of the third embodiment, shapes of the supporting holes of the supporting member 202 are different from each other. Specifically, among the supporting holes supporting the rotational shaft 201*b*, a long hole 202*g*, i.e., the supporting hole located at the body outer side, is formed into an arc long hole extending obliquely upward and upstream in the sheet feeding direction on the basis of the supporting portion of the rotational shaft 201*b* (FIG. 16A). That is, the long hole is formed into an arc in which the hole extends upward and upstream in the sheet feeding direction from the supporting position. Still further, among the supporting holes of the supporting member 202, the supporting hole 202*b* located at the body inner side in the sheet width direction is formed into a circular mortar shape whose diameter changes in the direction of the rotational shaft 201*b* of the detecting lever 201 similarly to one described in the third embodiment.

When the detecting lever 201 is attached to such supporting member 202, one end portion of the rotational shaft 201*b* of the detecting lever 201 is supported by a lower end of the long hole 202*g* of the supporting member 202 and another end portion is supported by the circular supporting hole 202*b* of the supporting member 202. In this state, the rotational shaft 201*b* is supported while having fitting backlash in the sheet feeding direction Z. The relationships between the detecting lever 201 and the sheet S and between the detecting lever 201 and the sheet detecting sensor 203 are the same with those described in the third embodiment.

Here, actions of the detecting lever 201 taken place when the detecting lever 201 receives a force in the sheet width direction A will be described with reference to FIGS. 16A through 16D. FIGS. 16A through 16D illustrate the actions of the sheet detecting lever 201, in order of time series, taken place when the sheet detecting lever 201 receives the force in the sheet width direction A. Here, a turning direction of the detecting lever 201 will be indicated by 'R' and moving directions of the sheet detecting lever 201 in the order of the time series will be indicated by 'X6 and X7'.

Figure 16B:
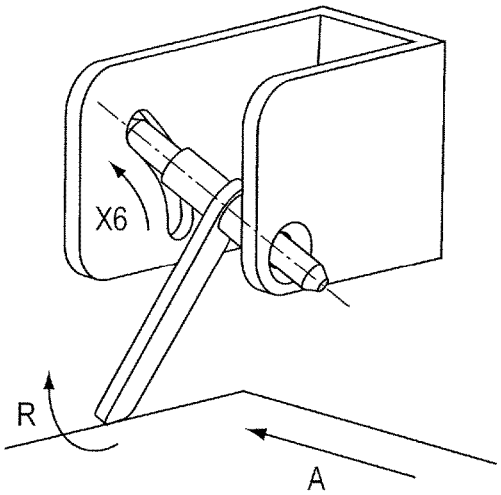
FIG. 16B illustrates the sheet detecting device in a state in which the sheet is moved further in the sheet width direction from the state shown in FIG. 16A.
Figure 16C:
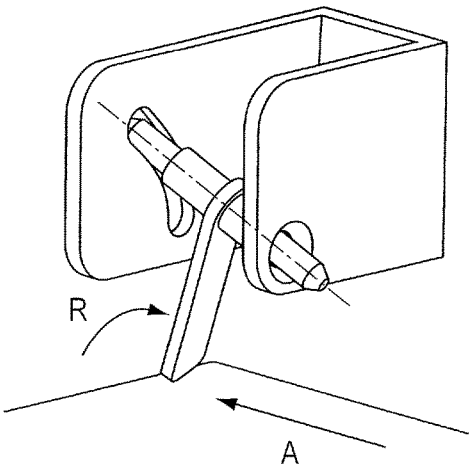
FIG. 16C illustrates the sheet detecting device in a state in which the sheet is moved further in the sheet width direction from the state shown in FIG. 16B.
Figure 16D:
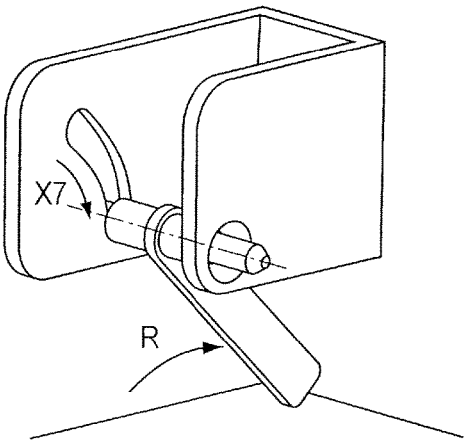
FIG. 16D illustrates the sheet detecting device in a state in which the detecting lever is moved to the sheet detecting position.

When the sheet S pushes the side edge of the detecting lever 201 in the sheet width direction A (FIG. 16A), one end portion at the body outer side of the rotational shaft 201*b* is lifted up obliquely and upstream in the sheet feeding direction in the direction X6 along the long hole 202*g* of the supporting portion as shown in FIG. 16B. Thereby, the rotational shaft 201*b* inclines in the direction R and in succession, the light blocking portion 201*a* turns in the direction R around the inclined rotational shaft 201*b* as shown in FIG. 16C. Then, finally, when the end portion of the detecting lever 201 is placed on the sheet as shown in FIG. 16D, the rotational shaft 201*b* moves within the long hole 202*g* in the direction X7 by its own weight and drops to a lower part of the long hole 202*g*, i.e., an initial position of the rotational shaft 201*b*. At this time, the light blocking portion 201*a*, i.e., the front end of the sheet detecting lever 201, turns in the direction R, i.e., to the side of the sheet feeding direction, and a direction of the light blocking portion 201*a* coincides with a direction of the sheet feeding direction Z. That is, the sheet detecting lever 201 comes to the position which is the same position where the sheet detecting lever 201 is positioned when the sheet S is appropriately placed on the feed tray 113 from the sheet feeding direction. This means that the sheet detecting lever 201 can be turned to the appropriate position even if the sheet S is placed in the sheet width direction A.

While one example has been described in each embodiment described above, the sheet detecting device, e.g., the sheet detecting device 45 or 200, in each embodiment includes the moving member, e.g., the detecting member 101 and the detecting lever 201, supported movably from the standby position, e.g., the positions shown in FIGS. 4A and 12A, to the detecting position, e.g., the positions shown in FIGS. 4C and 12E, in the state in which the sheet detecting device detects the sheet by being pressed by the sheet moving on the sheet stacking portion toward the first direction, e.g., the sheet feeding direction, the detecting sensor, e.g., the sheet detecting sensors 112 and 203. Still further, the sheet detecting device includes a retracting mechanism, e.g., the retract portion 123 and the supporting member 202, retracting the moving member movably to the detecting position in associate with the move of the sheet in the second direction, e.g., the sheet width direction, orthogonal to the first direction.

Then, according to the first and second embodiments, the sheet detecting device is configured such that the retract portion 123 retracts the detecting member 101 by interlocking with the operation of moving the edge restricting portion 120 performed along the widthwise move of the sheet. Still further, according to the third through sixth embodiments, the supporting hole of the supporting member supporting the rotational shaft of the detecting lever detecting whether or not a sheet is present is formed into the long hole shape extending upward and upstream in the sheet feeding direction from a normal supporting position of the rotational shaft of the detecting lever. Then, the sheet detecting device is configured to be able to turn the detecting lever in the direction orthogonal to the sheet feeding direction and in the sheet feeding direction when a force in a direction orthogonal to the sheet feeding direction is applied to the detecting lever by supporting the detecting lever turnably in the two directions of the sheet width direction and the sheet feeding direction.

Still further, it is possible to prevent erroneous detection of a sheet detecting sensor caused by setting of sheets on the feed tray carried out by the user by applying the sheet detecting device described above to the sheet feeding unit of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-239035, filed Nov. 26, 2014, and 2014-234146, filed Nov. 19, 2014, which are hereby incorporated by reference herein in their entirety.

What is claimed is:

1. A sheet detecting device, comprising:

a moving member moved by being pushed by a sheet;

a detecting sensor disposed below the moving member and configured to output a signal in response to movement of the moving member in a first direction; and a supporting member configured to support the moving member such that, if the moving member is pushed by a sheet in a second direction orthogonal to the first direction, the moving member retracts so as to move away from the detecting sensor in an upper direction.

2. The sheet detecting device according to claim 1, wherein the first direction is a feed direction in which the sheet is fed and the second direction is a sheet width direction orthogonal to the feed direction.

3. The sheet detecting device according to claim 1, wherein the moving member turns in the first direction centering on a rotational shaft in response to the push from the first direction.

4. The sheet detecting device according to claim 3, wherein the supporting member comprises a first supporting portion supporting one end of the rotational shaft such that the one end of the rotational shaft of the moving member moves in a direction opposite to the first direction when the moving member is pushed from the second direction.

5. The sheet detecting device according to claim 4, wherein the first supporting portion has a first hole allowing the one end of the rotational shaft to move in the direction opposite to the first direction.

6. The sheet detecting device according to claim 5, wherein the first hole is formed into a long hole extending upward and upstream, in a feed direction in which the sheet is fed, from a supporting position where the rotational shaft is rotably supported.

7. The sheet detecting device according to claim 4, wherein the supporting member comprises a second supporting portion supporting a second end of the rotational shaft of the moving member.

8. The sheet detecting device according to claim 7, wherein the second supporting portion has a second hole allowing the second end of the rotational shaft to move in the first direction when the one end of the rotational shaft moves in a direction opposite to the first direction.

9. The sheet detecting device according to claim 1, wherein the moving member is movable from a standby position by being pushed by the sheet and is configured to be positioned at the standby position by own weight or by an elastic force of an elastic member.

10. A sheet detecting device comprising:

a moving member configured to turn in a first direction centering on a rotational shaft by being pushed by a sheet from the first direction;

a detecting sensor configured to detect movement of the moving member; and a supporting member comprising:

a first supporting portion having a first hole allowing a first end of the rotational shaft to move in a direction opposite to the first direction if the moving member is pushed from a second direction orthogonal to the first direction; and a second supporting portion having a second hole allowing a second end of the rotational shaft to move in the first direction if the first end of the rotational shaft moves in a direction opposite to the first direction, wherein an inner diameter of the second hole on an inner side of the supporting member in terms of the second direction is greater than an inner diameter of the second hole on an outer side of the supporting member.

* * * * *